US009828715B2

(12) United States Patent
Kwon et al.

(10) Patent No.: US 9,828,715 B2
(45) Date of Patent: Nov. 28, 2017

(54) LAUNDRY MACHING HAVING A DRYING FUNCTION

(71) Applicant: LG ELECTRONICS INC., Seoul (KR)

(72) Inventors: Ig Geun Kwon, Seoul (KR); Sangwook Hong, Changwon-si (KR); Youngsuk Kim, Changwon-si (KR); Hyunseok Seo, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/017,905

(22) Filed: Feb. 8, 2016

(65) Prior Publication Data

US 2016/0153131 A1 Jun. 2, 2016

Related U.S. Application Data

(60) Continuation of application No. 14/173,928, filed on Feb. 6, 2014, now Pat. No. 9,255,353, which is a (Continued)

(30) Foreign Application Priority Data

May 28, 2009 (KR) ..... 10-2009-0047192
May 13, 2010 (KR) ..... 10-2010-0044794

(51) Int. Cl.
*D06F 58/24* (2006.01)
*D06F 25/00* (2006.01)

(Continued)

(52) U.S. Cl.
CPC ..... *D06F 25/00* (2013.01); *D06F 29/005* (2013.01); *D06F 39/04* (2013.01); *D06F 39/10* (2013.01);

(Continued)

(58) Field of Classification Search
CPC ..... D06F 25/00; D06F 29/005; D06F 39/04; D06F 39/10; D06F 58/22; D06F 58/04; D06F 58/24

(Continued)

(56) References Cited

U.S. PATENT DOCUMENTS 1,593,678 A 7/1926 Statler
2,856,699 A 10/1958 Frey (Continued)

FOREIGN PATENT DOCUMENTS

CN 1179489 A 4/1998
CN 1208787 2/1999

(Continued)

OTHER PUBLICATIONS

U.S. Appl. No. 13/320,697, filed Nov. 15, 2011, Benjamin Lee Osterhout.

(Continued)

*Primary Examiner* — Stephen M Gravini
(74) *Attorney, Agent, or Firm* — KED & Associates, LLP

(57) ABSTRACT

The present invention relates to a laundry machine having a drying function for drying an object to be dried, especially clothes. In the laundry machine according to one embodiment of the present invention, lint and the like that may be contained in the hot air are removed by the filter, whereby the lint and the like can be prevented from being piled on the duct. Also, the filter is placed in a way that it is exposed into the tub, whereby the filter can be cleaned automatically while it is being driven.

19 Claims, 13 Drawing Sheets

Related U.S. Application Data division of application No. 13/266,838, filed as application No. PCT/KR2010/003406 on May 28, 2010, now Pat. No. 8,800,165.

(51) Int. Cl.

| | |
|---|---|
| ***D06F 29/00*** | (2006.01) |
| ***D06F 58/22*** | (2006.01) |
| ***D06F 39/04*** | (2006.01) |
| ***D06F 39/10*** | (2006.01) |
| *D06F 58/04* | (2006.01) |

(52) U.S. Cl.

CPC ..... *D06F 58/22* (2013.01); *D06F 58/04* (2013.01); *D06F 58/24* (2013.01)

(58) Field of Classification Search

USPC ..... 34/595; 68/5 C

See application file for complete search history.

(56) References Cited

U.S. PATENT DOCUMENTS

| | | | | |
|---|---|---|---|---|
| 3,275,152 | A | 9/1966 | Searle | |
| 3,387,310 | A | 6/1968 | Marshall | |
| 3,509,742 | A | 5/1970 | Bauer | |
| 4,033,047 | A | 7/1977 | Kawai | |
| 4,204,339 | A | 5/1980 | Muller | |
| 4,891,892 | A | 1/1990 | Narang | |
| 4,899,462 | A | 2/1990 | Putnam et al. | |
| 5,231,805 | A | 8/1993 | Sander | |
| 5,259,218 | A | 11/1993 | Broadbent | |
| 5,582,040 | A | 12/1996 | Khan | |
| 5,588,313 | A | 12/1996 | Hildebrand | |
| 5,711,170 | A | 1/1998 | Johnson | |
| 5,735,006 | A | 4/1998 | Vande Haar | |
| 6,256,823 | B1 | 7/2001 | Kronbetter et al. | |
| 6,557,383 | B1 | 5/2003 | Ito et al. | |
| 6,585,781 | B1 | 7/2003 | Roseen | |
| 6,941,680 | B1 | 9/2005 | Zielewicz et al. | |
| 6,966,124 | B2 | 11/2005 | Ryu | |
| 7,020,985 | B2 | 4/2006 | Casey et al. | |
| 7,020,986 | B1 | 4/2006 | Nakai et al. | |
| 7,168,274 | B2 | 1/2007 | Slutsky et al. | |
| 7,251,963 | B2 | 8/2007 | Kim et al. | |
| 7,398,662 | B2 | 7/2008 | Kim et al. | |
| 7,458,171 | B1 | 12/2008 | Lentz | |
| 8,028,439 | B2 | 10/2011 | Prajescu | |
| 8,201,345 | B2 | 6/2012 | Dalton et al. | |
| 8,256,137 | B2 | 9/2012 | Noviello et al. | |
| 8,438,750 | B2 | 5/2013 | Dittmer et al. | |
| 8,468,711 | B2 | 6/2013 | Kim et al. | |
| 8,490,294 | B2 | 7/2013 | Brunert | |
| 8,607,473 | B2 | 12/2013 | Choi et al. | |
| 8,615,895 | B2 | 12/2013 | Shin et al. | |
| 8,627,580 | B2 | 1/2014 | Kim et al. | |
| 8,627,581 | B2 | 1/2014 | Brown | |
| 8,661,707 | B2 | 3/2014 | Dittmer et al. | |
| 8,667,705 | B2 | 3/2014 | Shin et al. | |
| 8,800,165 | B2 * | 8/2014 | Kwon | D06F 25/00 134/18 |
| 8,863,401 | B2 | 10/2014 | Grunert et al. | |
| 8,984,767 | B2 | 3/2015 | Grunert et al. | |
| 8,997,377 | B2 | 4/2015 | Kim et al. | |
| 9,027,256 | B2 | 5/2015 | Kim et al. | |
| 9,194,073 | B2 * | 11/2015 | Kwon | D06F 25/00 |
| 9,200,837 | B2 * | 12/2015 | Kwon | D06F 25/00 |
| 9,200,838 | B2 * | 12/2015 | Kwon | D06F 25/00 |
| 9,255,353 | B2 * | 2/2016 | Kwon | D06F 25/00 |
| 2004/0107742 | A1 | 6/2004 | Kim et al. | |
| 2004/0123631 | A1 | 7/2004 | Chang | |
| 2004/0148978 | A1 | 8/2004 | Kim et al. | |
| 2004/0163426 | A1 | 8/2004 | Kim et al. | |
| 2004/0216326 | A1 | 11/2004 | Kitamura et al. | |
| 2004/0221474 | A1 | 11/2004 | Slutsky et al. | |
| 2004/0226321 | A1 | 11/2004 | Park et al. | |
| 2004/0261469 | A1 | 12/2004 | Park et al. | |
| 2005/0120715 | A1 | 6/2005 | Labrador | |
| 2005/0183472 | A1 | 8/2005 | Choi | |
| 2005/0262879 | A1 | 12/2005 | Kim et al. | |
| 2005/0274159 | A1 | 12/2005 | Jeon et al. | |
| 2006/0010935 | A1 | 1/2006 | Park et al. | |
| 2006/0016228 | A1 | 1/2006 | Chang et al. | |
| 2006/0053838 | A1 | 3/2006 | Inuzuka et al. | |
| 2006/0075791 | A1 | 4/2006 | Seo et al. | |
| 2006/0101865 | A1 | 5/2006 | Jeon et al. | |
| 2006/0169006 | A1 | 8/2006 | Kim et al. | |
| 2006/0174663 | A1 | 8/2006 | Cimetta et al. | |
| 2006/0174665 | A1 | 8/2006 | Namkung et al. | |
| 2007/0051142 | A1 | 3/2007 | Lim et al. | |
| 2007/0074543 | A1 | 4/2007 | Lim et al. | |
| 2007/0227200 | A1 | 10/2007 | Kim et al. | |
| 2007/0289339 | A1 | 12/2007 | Lim | |
| 2008/0099052 | A1 | 5/2008 | Lee et al. | |
| 2008/0264114 | A1 | 10/2008 | Jang et al. | |
| 2008/0276656 | A1 | 11/2008 | Kitamura et al. | |
| 2008/0282746 | A1 | 11/2008 | Komori | |
| 2008/0307833 | A1 | 12/2008 | Chang et al. | |
| 2009/0044574 | A1 | 2/2009 | Lim et al. | |
| 2009/0056389 | A1 | 3/2009 | Pinkowski et al. | |
| 2009/0178442 | A1 | 7/2009 | Kawabata et al. | |
| 2009/0178445 | A1 | 7/2009 | Brinkmann | |
| 2010/0306928 | A1 | 12/2010 | Kimm et al. | |
| 2011/0173834 | A1 | 7/2011 | Arrigoni et al. | |
| 2012/0000087 | A1 | 1/2012 | Da Riol et al. | |
| 2012/0090189 | A1 | 4/2012 | Kwon et al. | |
| 2013/0091726 | A1 | 4/2013 | Kim et al. | |
| 2013/0139402 | A1 | 6/2013 | Hong | |
| 2013/0205840 | A1 | 8/2013 | Hong et al. | |
| 2013/0219734 | A1 | 8/2013 | Kim et al. | |
| 2013/0255099 | A1 | 10/2013 | Cavarretta et al. | |
| 2013/0263630 | A1 | 10/2013 | Doh et al. | |
| 2013/0291395 | A1 | 11/2013 | Doh et al. | |
| 2013/0318813 | A1 | 12/2013 | Hong et al. | |
| 2014/0150277 | A1 | 6/2014 | Kwon et al. | |
| 2014/0150279 | A1 | 6/2014 | Kwon et al. | |
| 2014/0208609 | A1 | 7/2014 | Han et al. | |
| 2016/0153131 | A1 * | 6/2016 | Geun | D06F 58/22 68/5 C |

FOREIGN PATENT DOCUMENTS

| | | | |
|---|---|---|---|
| CN | 1508349 | A | 6/2004 |
| CN | 1511996 | | 7/2004 |
| CN | 1540085 | A | 10/2004 |
| CN | 1548627 | A | 11/2004 |
| CN | 1707010 | A | 12/2005 |
| CN | 1724742 | A | 1/2006 |
| CN | 1730776 | A | 2/2006 |
| CN | 1730777 | A | 2/2006 |
| CN | 1730778 | A | 2/2006 |
| CN | 1814895 | | 8/2006 |
| CN | 1844543 | A | 10/2006 |
| CN | 1906351 | A | 1/2007 |
| CN | 1940166 | A | 4/2007 |
| CN | 101046046 | A | 10/2007 |
| CN | 101173482 | | 5/2008 |
| CN | 101343826 | | 1/2009 |
| CN | 101381946 | A | 3/2009 |
| CN | 100513673 | | 7/2009 |
| DE | 25 03 576 | | 8/1976 |
| DE | 34 38 575 | | 4/1986 |
| DE | 41 04 450 | | 8/1992 |
| DE | 44 13 069 | A1 | 10/1994 |
| DE | 297 16 968 | | 11/1997 |
| DE | 198 56 973 | | 6/1999 |
| DE | 103 42 254 | B3 | 11/2004 |
| DE | 10 2006 012 035 | | 3/2007 |
| DE | 10 2006 031 352 | | 1/2008 |
| EP | 0 152 745 | | 8/1985 |
| EP | 0 443 361 | | 8/1991 |
| EP | 0 648 885 | | 4/1995 |
| EP | 0 250 870 | | 1/1998 |
| EP | 0 816 549 | | 1/1998 |

(56) References Cited

FOREIGN PATENT DOCUMENTS

| | | | | |
|---|---|---|---|---|
| EP | 1 079 014 | A1 | | 2/2001 |
| EP | 1 270 791 | A2 | | 1/2003 |
| EP | 1 433 890 | A2 | | 6/2004 |
| EP | 1 445 368 | A2 | | 8/2004 |
| EP | 1 529 869 | | | 5/2005 |
| EP | 1 605 088 | A2 | | 12/2005 |
| EP | 1619286 | B1 | | 1/2006 |
| EP | 1 669 487 | | | 6/2006 |
| EP | 1 688 524 | | | 8/2006 |
| EP | 1 688 525 | A1 | | 8/2006 |
| EP | 1 688 531 | A1 | | 8/2006 |
| EP | 1 690 969 | | | 8/2006 |
| EP | 1 710 340 | | | 10/2006 |
| EP | 1 722 025 | A1 | | 11/2006 |
| EP | 1 746 192 | A2 | | 1/2007 |
| EP | 1 770 199 | A2 | | 4/2007 |
| EP | 1 840 257 | A1 | | 10/2007 |
| EP | 1 857 583 | A1 | | 11/2007 |
| EP | 1 881 099 | A1 | | 1/2008 |
| EP | 1 975 298 | A1 | | 10/2008 |
| EP | 2 039 819 | | | 3/2009 |
| EP | 2 053 157 | A1 | | 4/2009 |
| EP | 2 075 364 | | | 7/2009 |
| EP | 2 078 777 | | | 7/2009 |
| EP | 2 435 624 | | | 12/2010 |
| EP | 2 390 401 | | | 11/2011 |
| FR | 2 931 489 | | | 11/2009 |
| GB | 913801 | A | | 12/1962 |
| GB | 1181797 | A | | 2/1970 |
| GB | 2 091 123 | | | 7/1982 |
| GB | 2 279 968 | A | | 1/1995 |
| JP | 52-131661 | | | 11/1977 |
| JP | 7-275591 | | | 1/1995 |
| JP | 7-124382 | | | 5/1995 |
| JP | 10-211393 | | | 8/1998 |
| JP | 2003-245489 | | | 9/2003 |
| JP | 2004-000806 | | | 1/2004 |
| JP | 3502039 | B2 | | 3/2004 |
| JP | 2004-344373 | | | 12/2004 |
| JP | 2006-061613 | | | 3/2006 |
| JP | 2007-282962 | | | 11/2007 |
| JP | 2008-006045 | | | 1/2008 |
| JP | 2008-259665 | | | 10/2008 |
| JP | 2009-028400 | A | | 2/2009 |
| JP | 2009-060990 | | | 3/2009 |
| JP | 2009-61217 | | | 3/2009 |
| KR | 1996-0014478 | | | 5/1996 |
| KR | 10-2000-0056255 | | | 9/2000 |
| KR | 20-0209988 | | | 1/2001 |
| KR | 10-2001-0071245 | | | 7/2001 |
| KR | 10-0305057 | | | 7/2001 |
| KR | 10-2002-0056323 | | | 7/2002 |
| KR | 10-2002-0091795 | | | 12/2002 |
| KR | 10-2003-0092185 | | | 12/2003 |
| KR | 10-2004-0046973 | | | 6/2004 |
| KR | 10-2005-0006330 | | | 1/2005 |
| KR | 10-2005-0022659 | | | 3/2005 |
| KR | 10-2005-0108609 | A | | 11/2005 |
| KR | 10-2005-0113955 | | | 12/2005 |
| KR | 10-2006-0009075 | | | 1/2006 |
| KR | 10-2006-0040814 | | | 5/2006 |
| KR | 10-2006-0046969 | | | 5/2006 |
| KR | 10-2006-0089069 | | | 8/2006 |
| KR | 10-2006-0095816 | A | | 9/2006 |
| KR | 10-2006-0107037 | | | 10/2006 |
| KR | 10-2006-0117528 | | | 11/2006 |
| KR | 10-0651853 | | | 12/2006 |
| KR | 10-0697021 | | | 3/2007 |
| KR | 10-0700793 | | | 3/2007 |
| KR | 10-2007-0059431 | A | | 6/2007 |
| KR | 10-0730919 | | | 6/2007 |
| KR | 10-2007-00768 53 | | | 7/2007 |
| KR | 10-0743707 | | | 7/2007 |
| KR | 10-2007-0078602 | | | 8/2007 |
| KR | 10-0751783 | | | 8/2007 |
| KR | 10-2007-0101688 | | | 10/2007 |
| KR | 10-2007-0101732 | A | | 10/2007 |
| KR | 10-2008-0002475 | | | 1/2008 |
| KR | 10-2008-0018747 | | | 2/2008 |
| KR | 10-0808192 | | | 2/2008 |
| KR | 10-2008-0026410 | | | 3/2008 |
| KR | 10-2008-0072187 | A | | 8/2008 |
| KR | 10-2008-0078328 | | | 8/2008 |
| KR | 10-2008-0095565 | | | 10/2008 |
| KR | 20100129242 | A | * | 12/2010 ..... D06F 25/00 |
| RU | 2 085 641 | | | 7/1999 |
| RU | 2182197 | | | 3/2002 |
| RU | 2 303 668 | | | 2/2007 |
| RU | 2 303 092 | | | 5/2007 |
| WO | WO 01/96647 | A1 | | 12/2001 |
| WO | WO 2005/017249 | A1 | | 2/2005 |
| WO | WO 2007/105843 | | | 9/2007 |
| WO | WO 2008/003592 | | | 1/2008 |
| WO | WO 2008/007888 | | | 1/2008 |
| WO | WO 2008/103007 | A2 | | 8/2008 |
| WO | WO 2009/015919 | | | 2/2009 |
| WO | WO 2009/035241 | | | 3/2009 |
| WO | WO 2009/040302 | A1 | | 4/2009 |
| WO | WO 2009/050095 | A1 | | 4/2009 |
| WO | WO 2009/148251 | | | 12/2009 |

OTHER PUBLICATIONS

U.S. Office Action issued in U.S. Appl. No. 13/320,697 dated Feb. 23, 2016.

Korean Office Action dated Aug. 5, 2016 issued in Application No. 10-2010-0044794.

Korean Notice of Allowance dated Dec. 28, 2016 issued in Application No. 10-2010-0047412 (English Translation).

International Search Report issued in PCT Application No. PCT/KR2010/003406 dated May 28, 2010.

International Search Report and Written Opinion dated Sep. 14, 2010 issued in Application No. PCT/KR2009/007869.

International Search Report and Written Opinion dated Oct. 27, 2010 issued in Application No. PCT/KR2010/003379.

International Search Report and Written Opinion dated Oct. 27, 2010 issued in Application No. PCT/KR2010/003400.

International Search Report and Written Opinion dated Nov. 24, 2010 issued in Application No. PCT/KR2010/003376.

International Search Report and Written Opinion dated Nov. 24, 2010 issued in Application No. PCT/KR2010/003377.

International Search Report and Written Opinion dated Nov. 24, 2010 issued in Application No. PCT/KR2010/003378.

International Search Report and Written Opinion dated Nov. 29, 2010 issued in Application No. PCT/KR2010/003404.

International Search Report and Written Opinion dated Nov. 29, 2010 issued in Application No. PCT/KR2010/003405.

International Search Report and Written Opinion dated Nov. 29, 2010 issued in Application No. PCT/KR2010/003409.

International Search Report and Written Opinion dated Nov. 29, 2010 issued in Application No. PCT/KR2010/003410.

International Search Report and Written Opinion dated Jan. 21, 2011 issued in Application No. PCT/KR2010/003406.

International Search Report and Written Opinion dated Jan. 31, 2011 issued in Application No. PCT/KR2010/003408.

International Search Report and Written Opinion dated Jul. 19, 2011 issued in Application No. PCT/KR2009/007963.

International Search Report and Written Opinion dated Sep. 21, 2011 issued in Application No. PCT/KR2009/007960.

European Search Report dated Jul. 31, 2012 issued in Application No. 09 83 6377.

European Search Report dated Oct. 19, 2012 issued in Application No. 10 78 0817.

European Search Report dated Oct. 22, 2012 issued in Application No. 10 78 0819.

European Search Report dated Oct. 24, 2012 issued in Application No. 10 78 0823.

European Search Report dated Oct. 26, 2012 issued in Application No. 10 78 0820.

(56) References Cited

OTHER PUBLICATIONS

Chinese Office Action dated Dec. 25, 2012 issued in Application No. 200980155851.0 (with English translation).
Chinese Office Action dated Dec. 28, 2012 issued in Application No. 200980155608.9 (with English translation).
Chinese Office Action dated Mar. 5, 2013 issued in Application No. 201080017293.4 (with English translation).
Chinese Office Action dated Mar. 28, 2013 issued in Application No. 201080021257.5 (with English translation).
Chinese Office Action dated Jun. 4, 2013 issued in Application No. 201080021259.4 (with English translation).
Chinese Office Action dated Jun. 4, 2013 issued in Application No. 201080022490.5 (with English translation).
U.S. Office Action issued in U.S. Appl. No. 13/266,838 dated Nov. 14, 2013.
European Office Action dated Jan. 2, 2014.
Russian Office Action dated Jan. 22, 2014.
Russian Office Action dated Jan. 30, 2014.
European Office Action dated Feb. 5, 2014.
European Search Report dated Feb. 25, 2014 (10780805.7).
European Search Report dated Feb. 23, 2014 (10780803.2).
European Seach Report dated Feb. 26, 2014(10780804.0).
European Search Report dated Feb. 26, 2014 (10780806.5).
European Notice of Allowance dated Feb. 28, 2014 (10780823.0).
European Search Report dated Mar. 19, 2014 (13198677.0).
U.S. Office Action issued in U.S. Appl. No. 13/320,697 dated Apr. 11, 2014.
Russian Decision on Grant Action dated May 15, 2014. (translation).
U.S. Office Action issued in U.S. Appl. No. 13/318,655 dated Jun. 12, 2014.
U.S. Office Action issued in U.S. Appl. No. 13/258,965 dated Jun. 17, 2014.
U.S. Office Action issued in U.S. Appl. No. 13/318,655 dated Aug. 4, 2014.
Russian Office Action dated Aug. 29, 2014 (2011147482).
Russian Office Action dated Aug. 29, 2014 (2011146320).
U.S. Office Action issued in U.S. Appl. No. 13/142,620 dated Sep. 3, 2014.
U.S. Office Action issued in U.S. Appl. No. 13/259,709 dated Sep. 9, 2014.
U.S. Office Action issued in U.S. Appl. No. 13/259,832 dated Oct. 2, 2014.
U.S. Office Action issued in U.S. Appl. No. 13/142,986 dated Nov. 6, 2014.
U.S. Office Action dated Nov. 18, 2014 issued in U.S. Appl. No. 13/143,032.
U.S. Office Action dated Nov. 20, 2014 issued in U.S. Appl. No. 13/259,016.
U.S. Office Action dated Dec. 29, 2014 issued in U.S. Appl. No. 13/266,895.
U.S. Final Office Action dated Jan. 9, 2015 issued in U.S. Appl. No. 13/318,655.
U.S. Final Office Action dated Jan. 21, 2015 issued in U.S. Appl. No. 13/142,620.
U.S. Final Office Action dated Feb. 5, 2015 issued in U.S. Appl. No. 13/319,167.
ABT-MAH2400WH.pdf, web page posted on www.abt.com on Mar. 2009; https://web.archive.org/web/__20090301015816/http://www.abt.com/__product/17027/Maytag-MAH2400AWW.html; retrieved by Examiner on Mar. 19, 2015.
Maytag-MAH2400AWW.pdf, web page posted on www.maytag.com on May 2005; https://web.archive.org/web/20050502164236/http://www.maytag.com/mths/products/product.jsp?model=MAH2400AWWW; retrieved by Examiner on Mar. 19, 2015.
Amazon-MAH2400AWW.pdf, web page posted on www.amazon.com on Mar. 2015; http:/www.amazon.com/Maytag-MAH2400AWWCompact-Front-Load-Capacity/dp/8000UVYEOM/ref=cm__cd__ql__qh__dp__t; retrieved by Examiner on Mar. 19, 2015.
U.S. Office Action issued in U.S. Appl. No. 13/143,032 dated Mar. 16, 2015.
U.S. Office Action issued in U.S. Appl. No. 13/259,016 dated Mar. 24, 2015.
U.S. Office Action issued in U.S. Appl. No. 13/318,549 dated Mar. 26, 2015.
U.S. Office Action issued in U.S. Appl. No. 13/320,697 dated Apr. 9, 2015.
U.S. Office Action issued in U.S. Appl. No. 13/259,754 dated May 6, 2015.
U.S. Final Office Action issued in U.S. Appl. No. 13/319,167 dated May 18, 2015.
U.S. Final Office Action issued in U.S. Appl. No. 13/142,633 dated May 29, 2015.
U.S. Office Action issued in U.S. Appl. No. 13/142,986 dated Jun. 5, 2015.
U.S. Office Action issued in U.S. Appl. No. 13/259,016 dated Jun. 17, 2015.
U.S. Office Action issued in U.S. Appl. No. 13/143,032 dated Jun. 29, 2015.
U.S. Office Action issued in U.S. Appl. No. 13/318,655 dated Jun. 30, 2015.
U.S. Notice of Allowance issued in U.S. Appl. No. 14/173,892 dated Jul. 27, 2015.
U.S. Notice of Allowance issued in U.S. Appl. No. 14/173,948 dated Jul. 27, 2015.
U.S. Notice of Allowanee issued in U.S. Appl. No. 14/173,908 dated Jul. 28, 2015.
U.S. Office Action issued in U.S. Appl. No. 13/142,620 dated Aug. 3, 2015.
Chinese Office Action dated Aug. 21, 2015 (201410148938.8).
Chinese Office Action dated Aug. 21, 2015. (201410149092.X).
Chinese Office Action dated Aug. 25, 2015.
Chinese Office Action dated Sep. 2, 2015.
European Office Action dated Oct. 8, 2015.
U.S. Office Action issued in U.S. Appl. No. 13/320,697 dated Oct. 18, 2017.

* cited by examiner

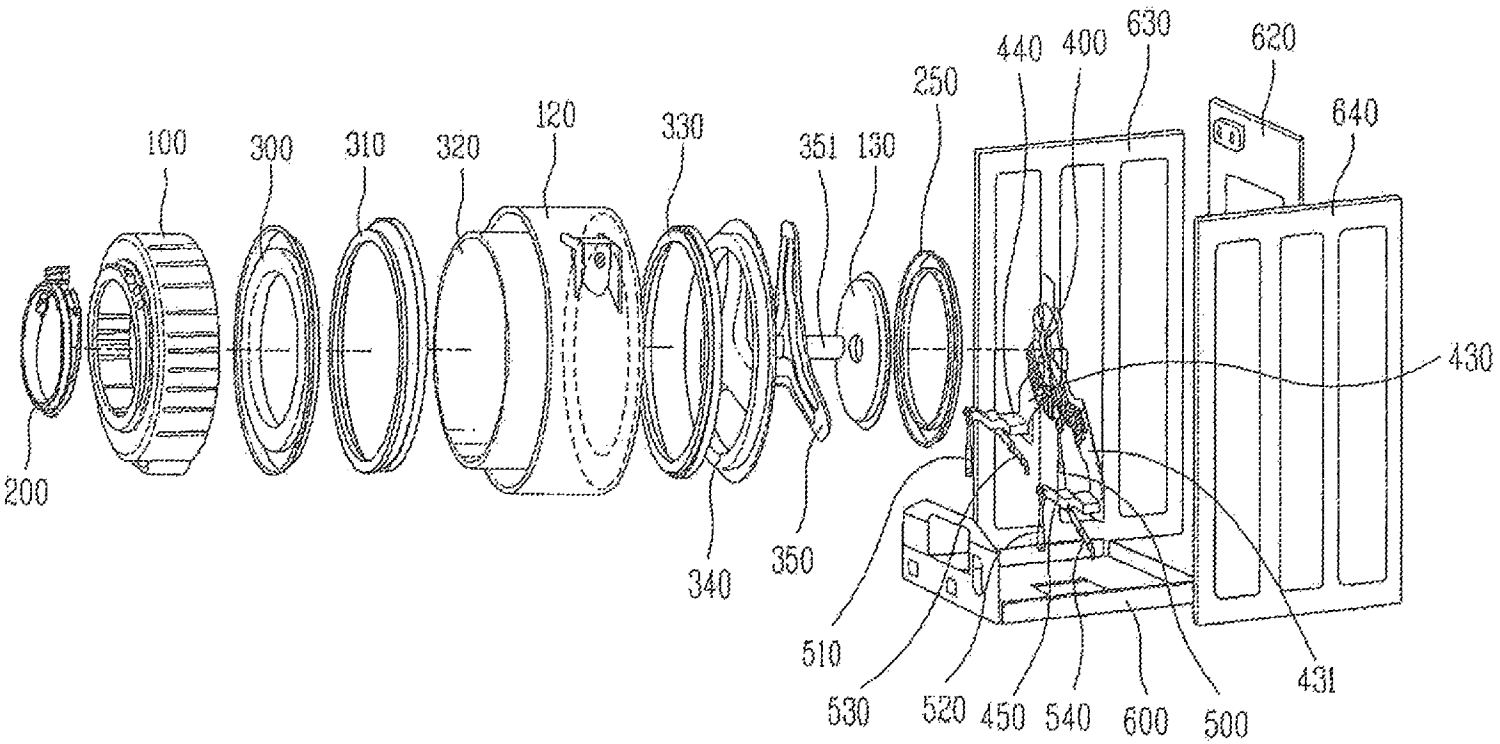
[Fig. 1]

[Fig. 2]
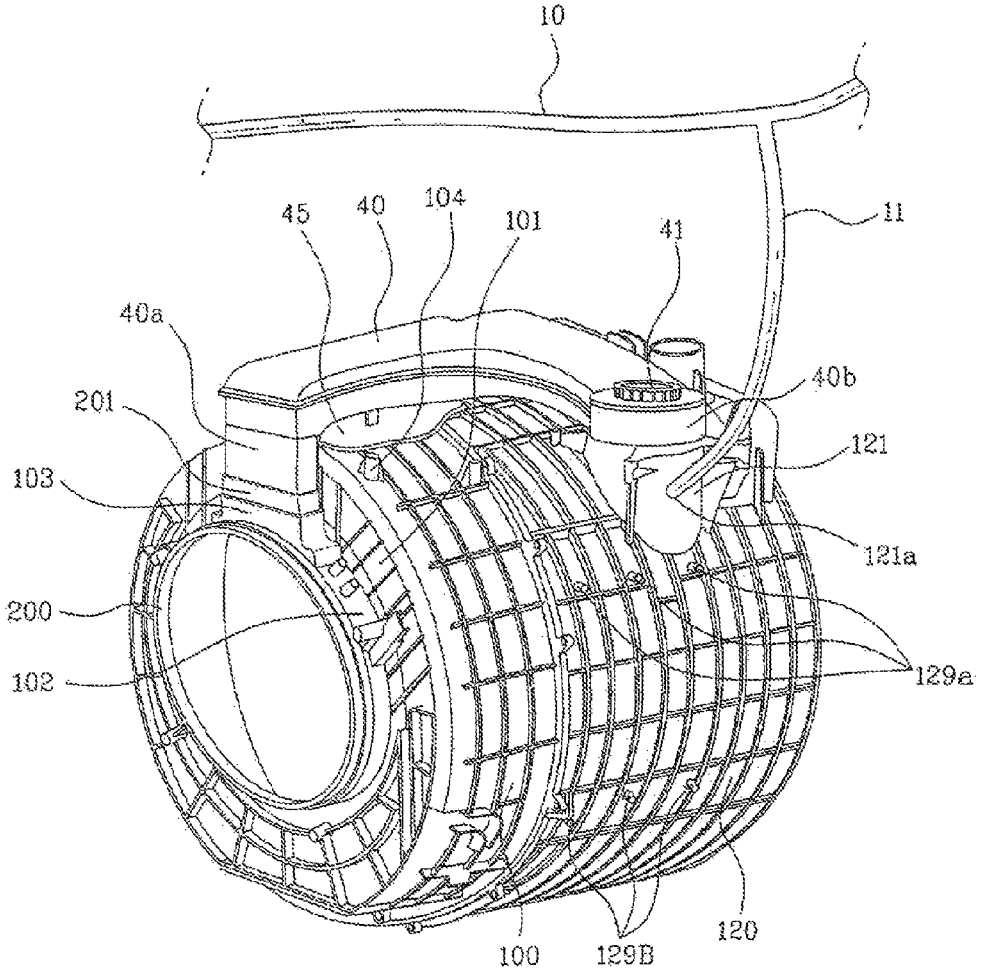

[Fig. 3]
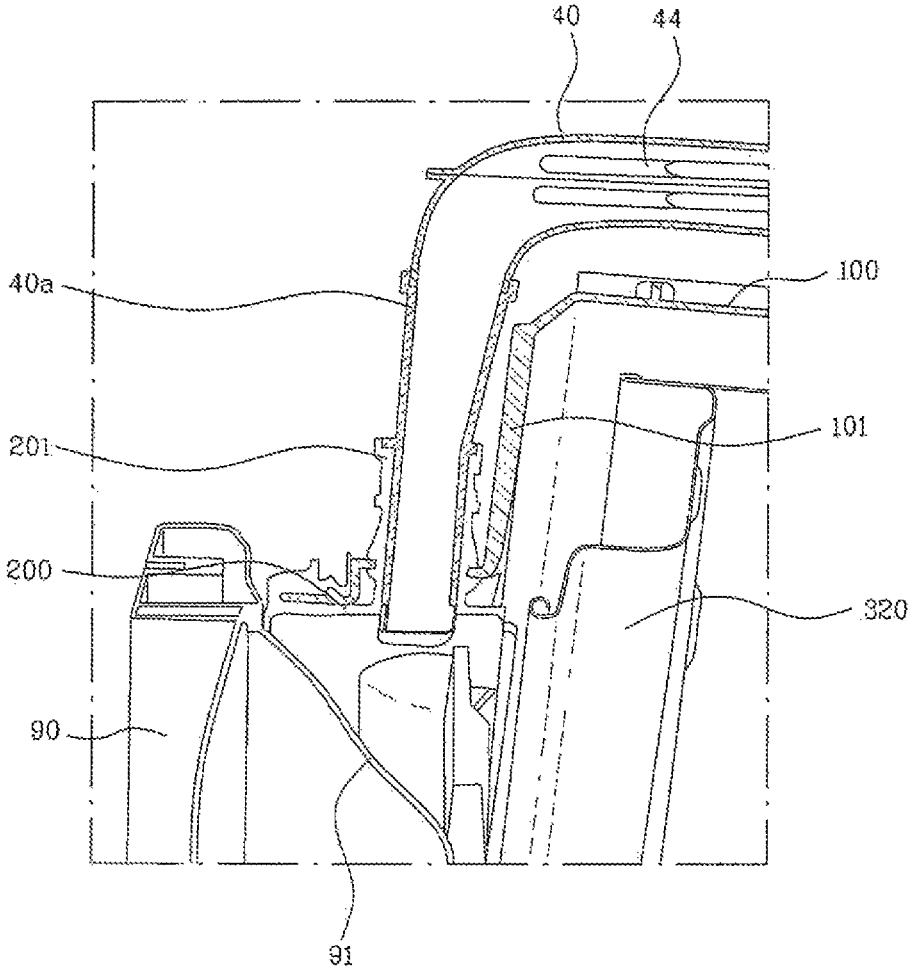

[Fig. 4]
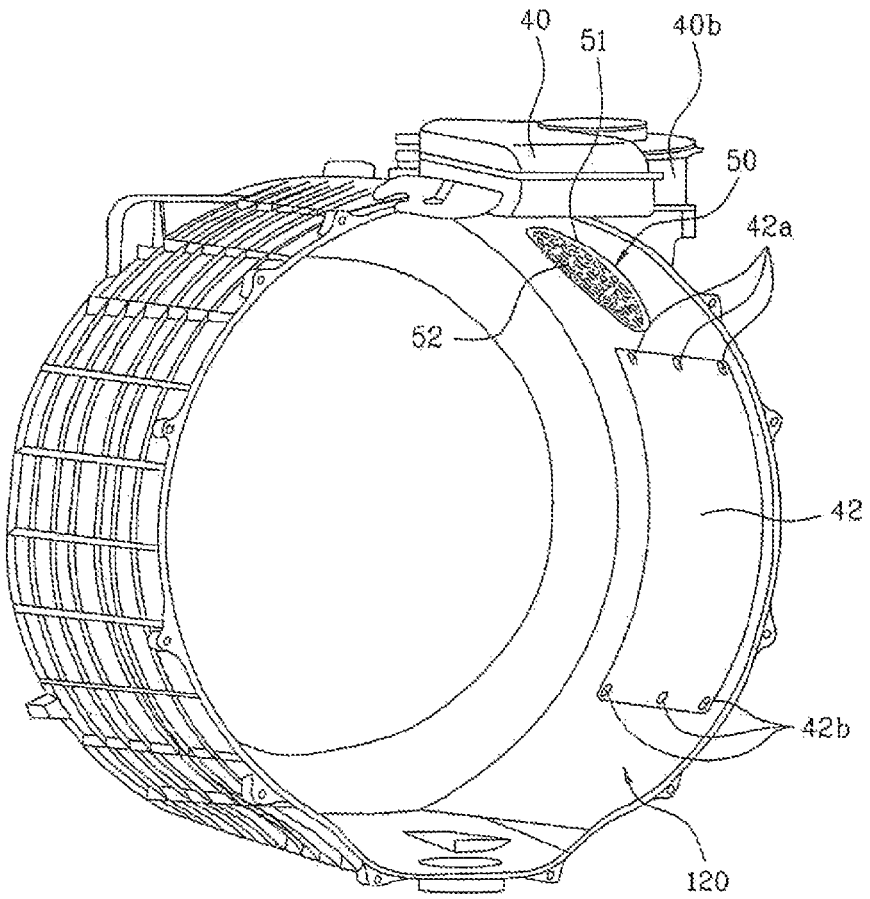

[Fig. 5]
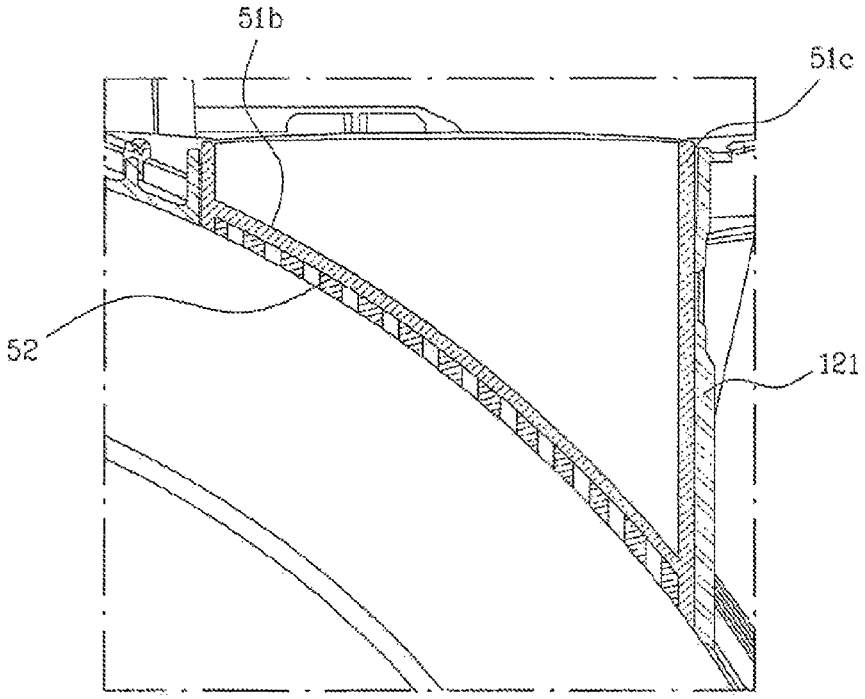

[Fig. 6]
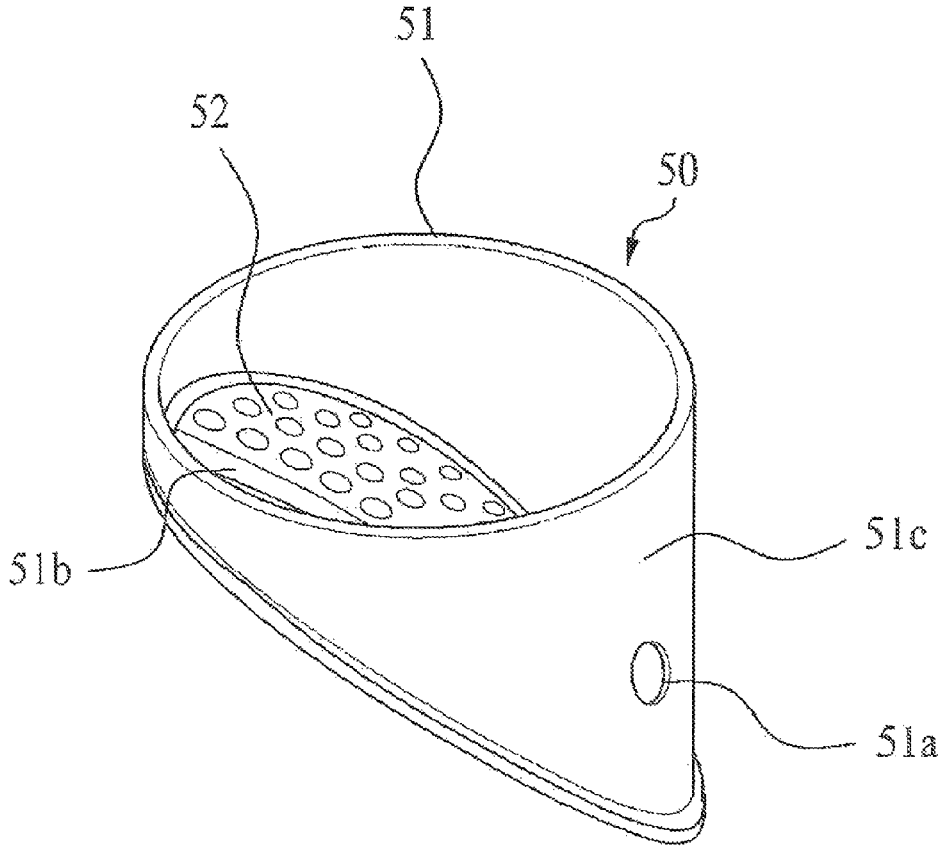

[Fig. 7]
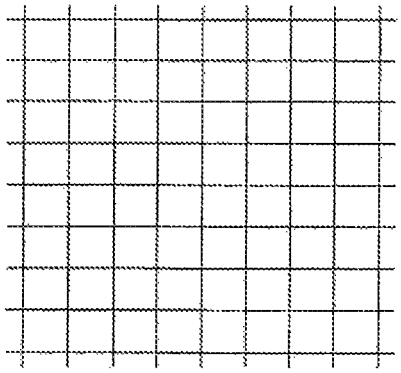
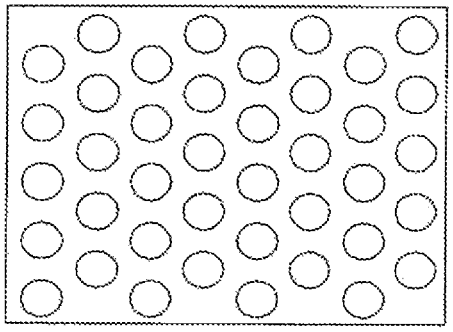

[Fig. 8]
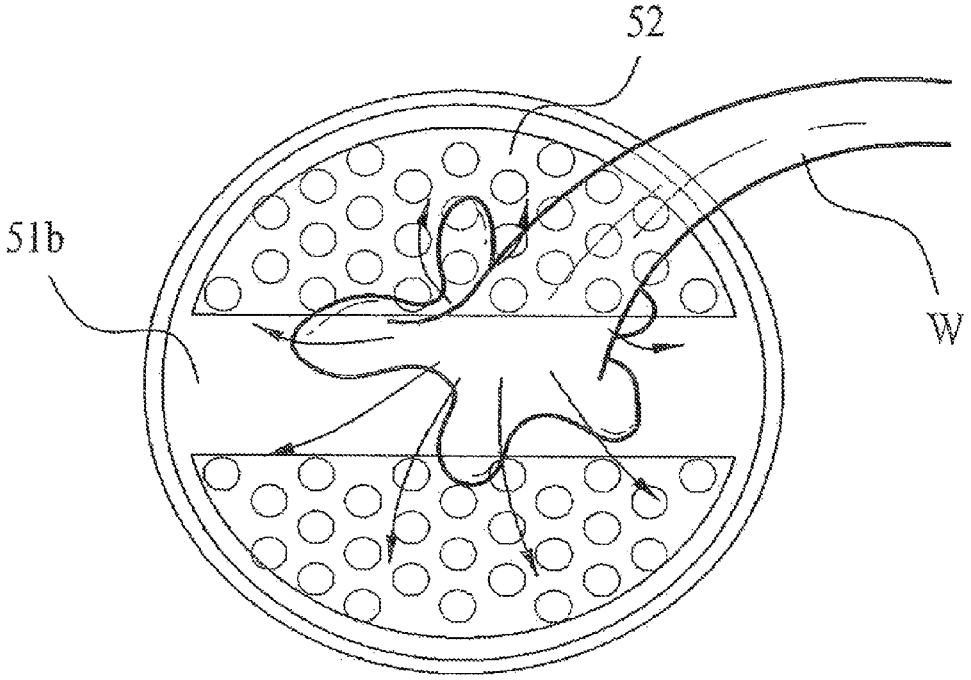

[Fig. 9]
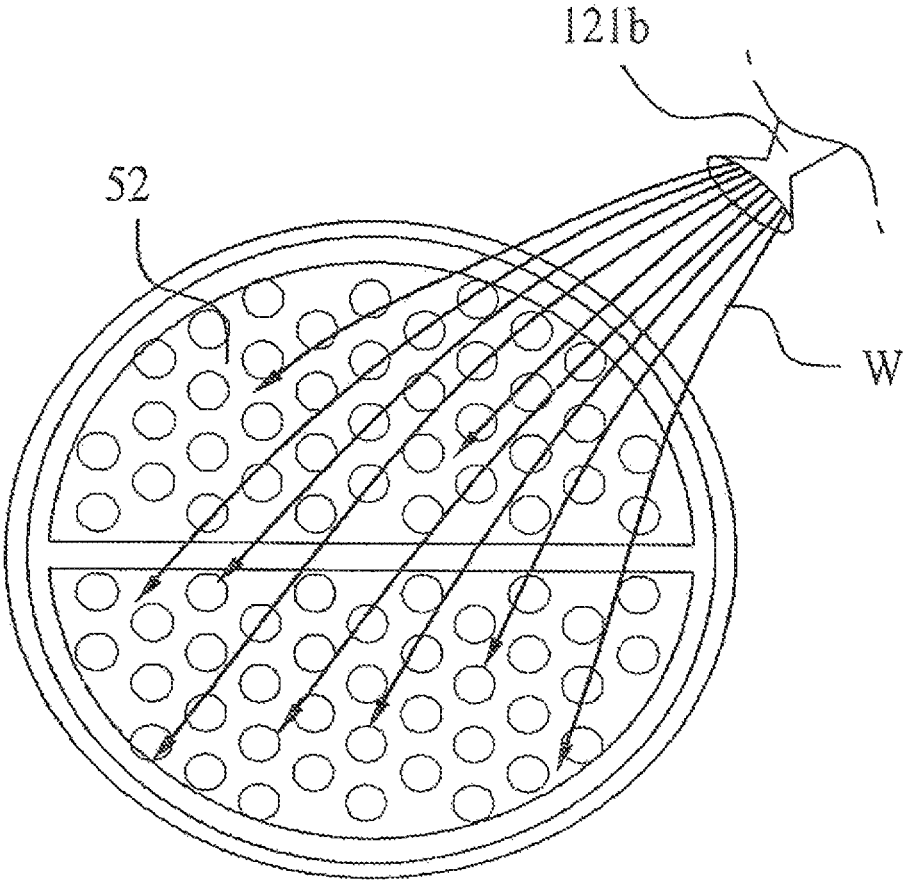

[Fig. 10]
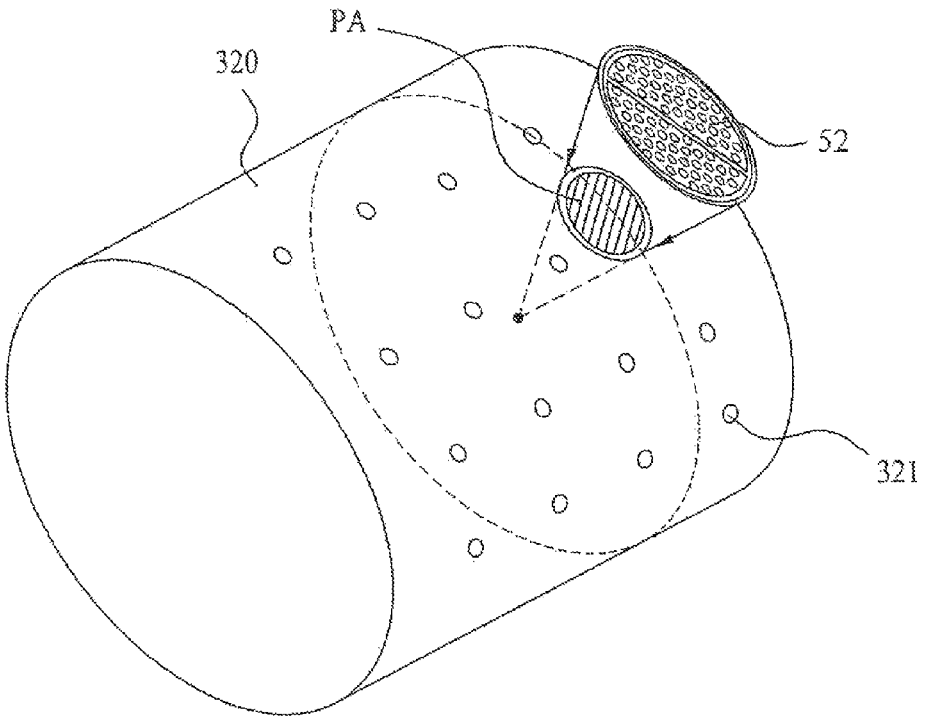

[Fig. 11]
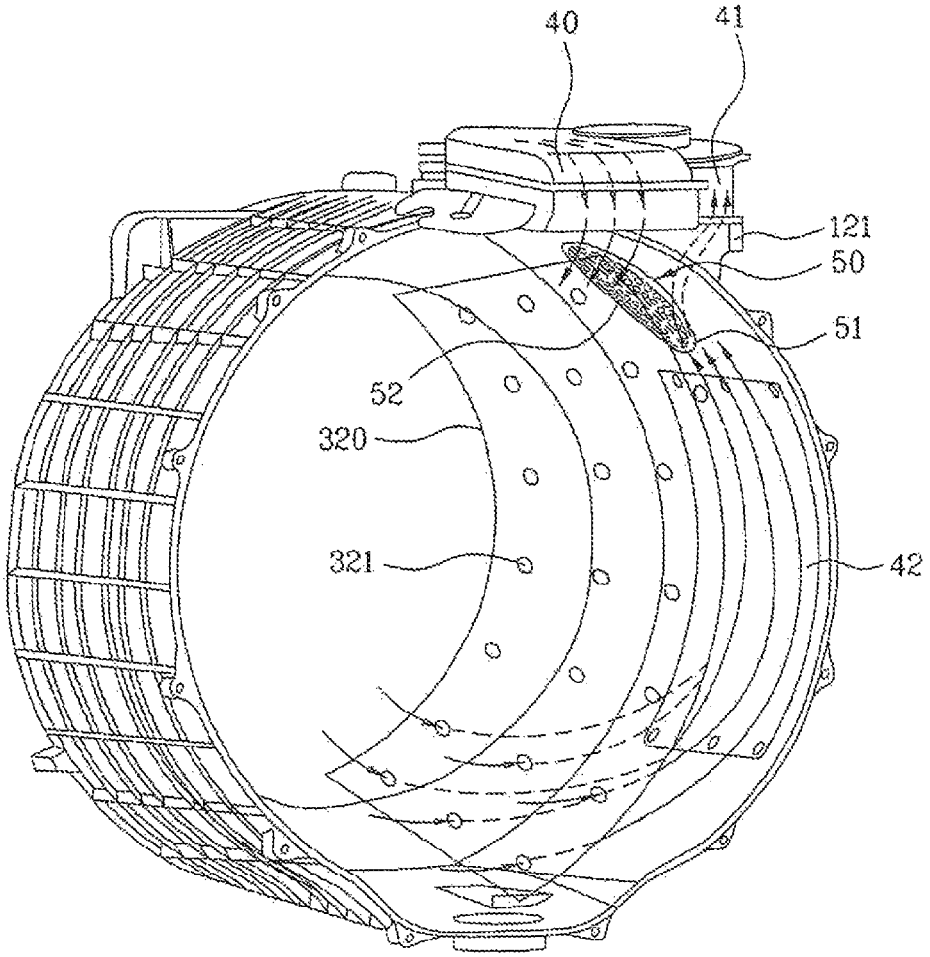

[Fig. 12]
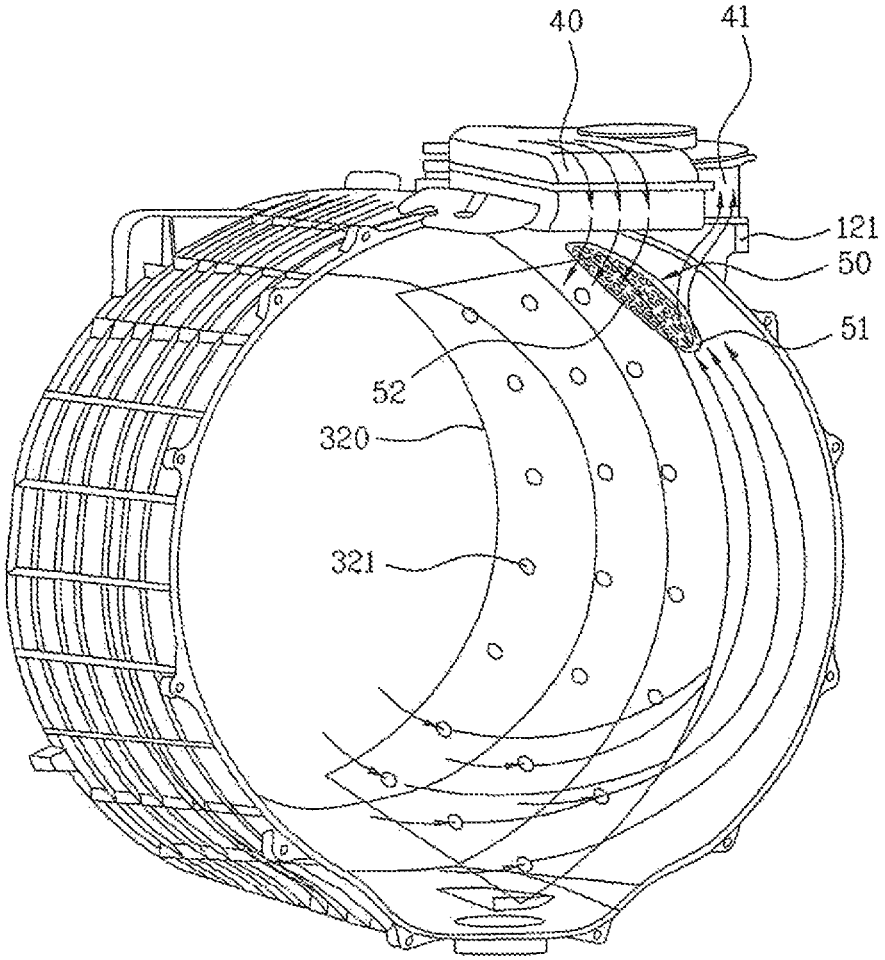

[Fig. 13]
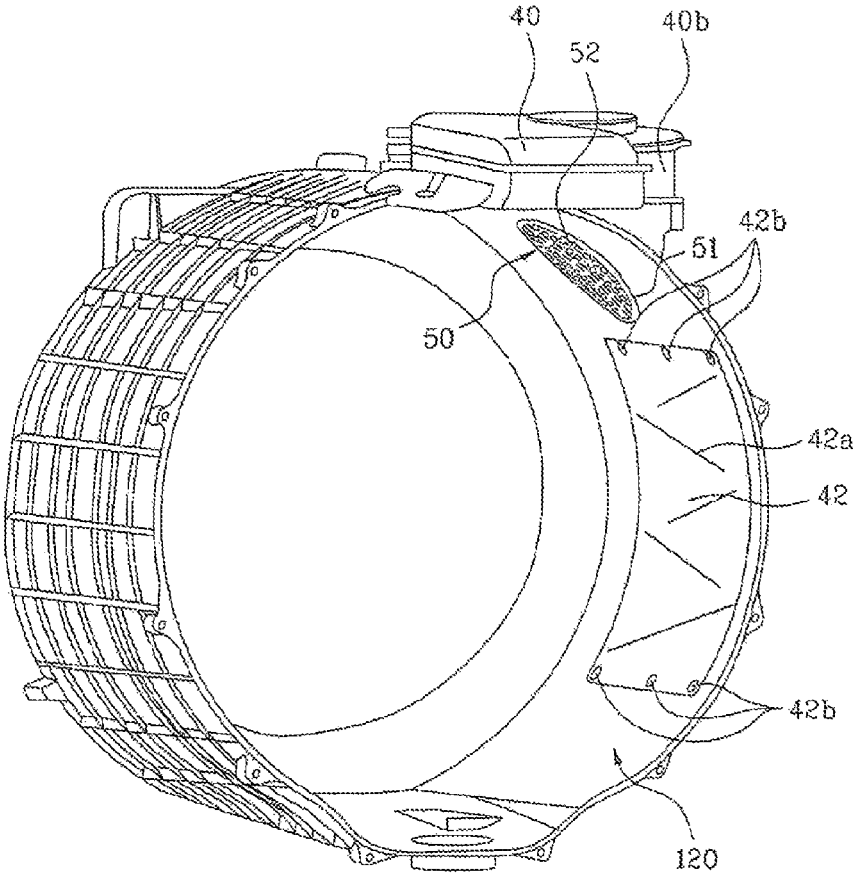
[Fig. 14]
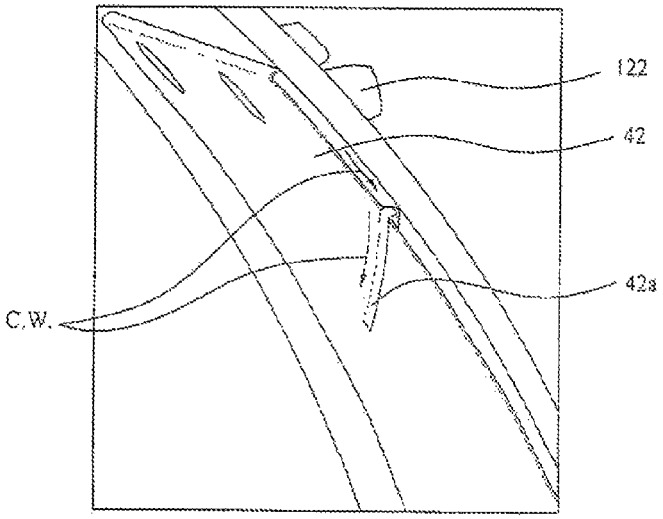

LAUNDRY MACHING HAVING A DRYING FUNCTION

CROSS-REFERENCE TO RELATED APPLICATIONS

This application is a Continuation Application of prior U.S. patent application Ser. No. 14/173,928 filed Feb. 6, 2014, which is a divisional of U.S. patent application Ser. No. 13/266,838 filed on Oct. 28, 2011, which is a National Stage Application of PCT/KR2010/003406 filed May 28, 2010, which claims priority to Korean Application Nos. 10-2009-0047192 filed on May 28, 2009 and 10-2010-0044794 filed on May 13, 2010, whose entire disclosures are hereby incorporated by reference.

BACKGROUND

1. Technical Field

The present invention relates to a machine having a drying function for drying an object to be dried, especially clothes. The machine can be referred to as a laundry machine having a drying function.

Examples of the laundry machine having a drying function include a drying machine having a drying function only and a laundry machine having a drying function together with a laundry function of clothes. Also, an example of the laundry machine includes a drum type laundry machine and a cabinet type laundry machine depending on a structure or type, wherein the drum type laundry machine dries laundry while tumbling the laundry using a rotatable drum, and the cabinet type laundry machine dries laundry by hanging the laundry up.

2. Background Art

Examples of the laundry machine having a drying function include a drying machine having a drying function only and a laundry machine having a drying function together with a laundry function of clothes. Also, an example of the laundry machine includes a drum type laundry machine and a cabinet type laundry machine depending on a structure or type, wherein the drum type laundry machine dries laundry while tumbling the laundry using a rotatable drum, and the cabinet type laundry machine dries laundry by hanging the laundry up.

Generally, a laundry machine having a drying function according to the related art includes a tub receiving washing water for washing. A drum where laundry is placed is rotatably provided within the tub.

The drum is connected with a rotational shaft, and a motor is used to rotate the rotational shaft.

The rotational shaft is rotatably supported through a bearing housing provided at a rear wall of the tub. The tub is connected with a suspension, and vibration of the drum and the tub is absorbed by the suspension.

For a drying function, the laundry machine includes a drying duct and a condensing duct. The drying duct is placed at a top portion of the tub and is provided with a heater and a fan therein. One end of the condensing duct is connected with the tub, and the other end of the condensing duct is connected with the drying duct.

Cooling water is supplied into the condensing duct to condense water contained in the wet air. The wet air flows into the drying duct after being condensed in contact with the cooling water while flowing along the condensing duct. In this way, the hot air returning to the drying duct is reheated by the heater and then is supplied into the tub again.

The above references are incorporated by reference herein where appropriate for appropriate teachings of additional or alternative details, features and/or technical background.

DISCLOSURE OF INVENTION

Technical Problem

An object of the present invention is to provide a laundry machine in which a filter provided to filter lint and the like from the hot air is automatically cleaned while it is being driven.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

Solution to Problem

A laundry machine according to one embodiment of the present invention can be placed in a way that a filter is exposed into a tub.

A hot air outlet where the hot air is discharged may be formed at a circumferential surface of the tub, and the filter may be placed at the hot air outlet.

The filter may be placed around a circumferential surface of a drum. In this case, the filter can be cleaned by airflow caused by rotation of the drum. If a rotational speed of the drum is great, air velocity of the rotational airflow becomes strong enough to clean the filter.

Meanwhile, lint and the like may be fixed to the surface of the filter in a state that they are dried. In this case, water is supplied to the lint to wet the lint. In case of a dehydrating stroke or cycle, water drops are spouted out from wet laundry through a through hole of the drum. The lint may be wetted in a way that the water drops is in contact with the filter. If the dehydrating stroke is carried out, the rotational speed of the drum is high and the water drops may approach to the filter as described above, whereby more excellent cleaning effect can be obtained.

A device for supplying fluid to help to clean the filter may be included. In other words, a filter cleaner may be added to supply fluid to the surface of the filter. Additionally or alternatively, the filter may be cleaned by water stored in the tub depending on a location of the filter. Namely, the filter may be cleaned in a way that washing water or rinsing water inside the tub approaches to the filter.

Meanwhile, the laundry machine according to one embodiment of the present invention includes a drum, a drive assembly for rotating the drum, and a suspension unit for reducing vibration of the drum.

The drive assembly includes a rotational shaft connected to the drum, a bearing housing rotatably supporting the rotational shaft, and a motor connected to the rotational shaft. In this case, the motor may be connected with the rotational shaft directly or indirectly.

The suspension unit includes a radius bracket and a shaft bracket.

The radius bracket could be a bracket extended from the bearing housing to the location spaced apart in a radius direction based on the rotational shaft. The shaft bracket could be a bracket extended from the bearing housing to the location spaced apart in a shaft direction.

Meanwhile, the tub receiving the washing water may be provided fixedly, or may be supported through a flexible support structure such as the suspension unit. Also, the tub may be supported at a middle level between the level supported by the suspension unit and the level supported fixedly.

In other words, the tub may be supported flexibly at the same level as the suspension unit, or may be supported more rigidly than the suspension unit. For example, the tub may be supported by the suspension unit, may be supported by a rubber bushing that can give flexibility to movement although not more flexible than the suspension unit, or may be provided fixedly.

Examples of the tub supported more rigidly than the suspension unit will be described in more detail.

First of all, at least a part of the tub may be formed in a single body with a cabinet. For example, the tub and the cabinet can be formed in a single body by injection molding. In more detail, a front portion of the tub and a front portion of the cabinet may be formed in a single body by injection molding.

Second, the tub may be supported by being connected to a screw, a rivet, or a rubber bushing, or may fixedly be supported by welding, adhesion sealing, or the like. In this case, such a connection member has rigidity greater than that of the suspension unit for an up and down direction of the drum, which corresponds to a main vibration direction of the drum.

The aforementioned tub could be extended within the possible range of the space where it is provided. In other words, the tub can be extended in a way that it approaches to a wall or frame (for example, left side or right side of the cabinet) that limits left and right sizes of the space, in at least left and right direction (direction horizontally crossing the shaft direction when the rotational shaft is placed horizontally). In this case, the tub may be formed at the left or right wall of the cabinet in a single body with the cabinet.

Relatively, the tub may be formed to be nearer to the wall or frame than the drum in the left and right direction. For example, the tub may be spaced apart from the wall or frame at an interval less than the interval with the drum by 1.5 times. In a state that the tub is extended in the left and right direction, the drum may also be extended in the left and right direction. And, if the left and right interval between the tub and the drum is small, the drum can be extended in the left and right direction as much as the left and right interval. In reducing the left and right interval between the tub and the drum, left and right vibration of the drum may be considered. If the left right vibration of the drum is small, a diameter of the drum can be more extended. Accordingly, a suspension unit that reduces the vibration of the drum can be formed with rigidity in a left and right direction, which is greater than rigidity in the other directions. For example, the suspension unit may be formed with maximum rigidity of displacement in a left and right direction, which is greater than that in the other directions.

Also, unlike the related art, the suspension unit may directly be connected with the bearing housing that supports the rotational shaft connected with the drum, without through the tub.

At this time, the suspension unit includes a bracket extended in the shaft direction of the rotational shaft. And, the bracket may be extended towards the front where a door is placed.

Meanwhile, the suspension unit includes two suspensions spaced apart from each other in the shaft direction of the rotations shaft.

Also, the suspension unit may include a plurality of suspensions formed below the rotational shaft to standing-support their support object (for example, drum). Alternatively, the suspension unit may include a plurality of suspensions formed above the rotational shaft to hang their support object up thereon. These cases correspond to the case where the suspensions are only provided below or above the rotational shaft.

The center of gravity of a vibration body that includes a drum, a rotational shaft, a bearing housing, and a motor can be directed towards the motor based on at least the center of a length direction of the drum.

At least one suspension may be placed at the front or rear of the center of gravity. Also, one suspension may respectively be placed before and after the center of gravity.

The tub may have an opening at the rear portion. A drive assembly that includes a rotational shaft, a bearing housing and a motor may be connected with the tub through a flexible member. The flexible member may be sealed to prevent the washing water from flowing out through the opening of the tub and allows relative movement of the drive assembly for the tub. This flexible member is formed of a flexible material that enables sealing, for example, a gasket material such as a front gasket. In this case, the flexible member may be referred to as a rear gasket corresponding to the front gasket. Connection of the drive assembly of the rear gasket can be made in a state that it is rotationally restrained for the rotational direction of the rotational shaft. For example, the rear gasket may directly be connected to the rotational shaft, or may be connected to an extension portion of the hearing housing.

Furthermore, a portion of the drive assembly, which is placed at the front of the connection portion with the rear gasket and can be exposed to the washing water within the tub, may be formed in a way that it is prevented from being corroded by the washing water. For example, the portion of the drive assembly may be coated, or may be surrounded with a separate part (for example, tub back) made of a plastic material. If a portion of the drive assembly, which is made of a metal material, is provided, the portion is not exposed to the water directly, whereby it can be prevented from being corroded.

Moreover, the laundry machine may not include the cabinet. For example, in case of a built-in laundry machine, instead of the cabinet, a space where the laundry machine will be placed may be provided by a wall structure. In other words, the laundry machine may be made in a type that it does not include a cabinet constituting appearance independently. However, in this case, a front side may be required.

Advantageous Effects of Invention

In the laundry machine according to one embodiment of the present invention, lint and the like that may be contained in the hot air are removed by the filter, whereby the lint and the like can be prevented from being piled on the duct.

Also, the filter is placed in a way that it is exposed into the tub, whereby the filter can be cleaned automatically while the laundry machine is being driven.

It is to be understood that both the foregoing general description and the following detailed description of the present invention are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a partial assembly perspective view illustrating the first embodiment of the present invention;

FIG. 2 is a diagram illustrating a tub and a drying module of the first embodiment;

FIG. 3 is a partial sectional view illustrating a hot air inlet of the first embodiment;

FIG. 4 is a diagram illustrating the inside of the tub;

FIG. 5 is a partial sectional view illustrating a filter assembly placed at a hot air outlet;

FIG. 6 is a diagram illustrating a filter assembly;

FIG. 7 is a diagram illustrating a wire filter at the left and a mesh filter at the right;

FIG. 8 is a diagram illustrating that washing water striking a collision surface and is spread over;

FIG. 9 is a diagram illustrating that washing water is spread over through a shower nozzle and supplied into a filter;

FIG. 10 is a diagram Illustrating that a filter is projected to an outer circumference of a drum in a radius direction;

FIG. 11 is a diagram illustrating a circulating passage of the hot air;

FIG. 12 is a diagram illustrating the second embodiment of the present invention; and FIG. 13 and FIG. 14 are diagrams illustrating the third embodiment of the present invention.

MODE FOR THE INVENTION

Hereinafter, the preferred embodiments of the present invention will be described with reference to the accompanying drawings. Wherever possible, the same reference numbers will be used throughout the drawings to refer to the same or like parts.

FIG. 1 is a partial exploded perspective view illustrating a laundry machine according to the first embodiment of the present invention. FIG. 1 briefly illustrates a whole structure of the laundry machine according to the first embodiment of the present invention, and some parts may be omitted in FIG. 1. Also, the laundry machine of FIG. 1 is a laundry machine having a drying function, in which a drying function and a washing function are provided. In this embodiment, a condensing chamber is a tub.

In the laundry machine according to the first embodiment of the present invention, a tub is fixedly supported to a cabinet. The tub includes a tub front 100 constituting a front portion and a tub layer 120 constituting a rear portion.

The tub front 100 and the tub layer 120 can be assembled by a screw, and form a space therein to receive a drum. The tub layer 120 has an opening at the rear. The tub layer 120 is connected with a rear gasket 250 at a portion where the opening is formed, wherein the rear gasket 250 is a flexible member. The rear gasket 250 may be connected with a tub back 130 at an inner portion of a radius direction. The tub back 130 is provided with a through hole at the center, through which a rotational shaft passes. The rear gasket 250 is formed flexibly in such a manner that vibration of the tub back 130 is not transferred to the tub layer 120.

The rear gasket 250 is connected with the tub back 130 and the tub layer 120 and sealed, so that washing water in the tub does not leak out. The tub back 130 is vibrated together with a drum when the drum is rotated. At this time, the tub back 130 is spaced apart from the tub layer 120 at a sufficient interval so as not to interfere with the tub layer 120. Since the rear gasket 250 can be varied flexibly, it allows relative movement of the tub back 130 without interference with the tub layer 120. The rear gasket 250 can have a curved portion or folding portion 252 that can be extended at a sufficient length to allow such relative movement of the tub back 130.

The tub has an inlet at the front thereof to put laundry in and out. At the front portion of the tub, where the inlet is placed, a front gasket 200 may be provided to prevent washing water from leaking out through the inlet, prevent laundry or other foreign substances from flowing between the tub and the drum, or carry out other function.

The drum includes a drum front 300, a drum center 320, and a drum back 340. A ball balancer may be provided at the front and rear portions of the drum, respectively. The drum back 340 is connected with a spider 350. The spider 350 is connected with a rotational shaft 351. The drum is rotated within the tub by a rotational force transferred through the rotational shaft 351.

The rotational shaft 351 is connected with a motor through the tub back 130. In this embodiment, the motor is connected with the rotational shaft. In other words, in this embodiment, the motor is directly connected to the rotational shaft. In more detail, a rotor of the motor is directly connected with the rotational shaft 351. A bearing housing 400 is fixed to a rear surface 128 of the tub back 130. The bearing housing 400 rotatably supports the rotational shaft 351 between the motor and the tub back 130.

A stator 80 is fixedly provided in the bearing housing 400. The rotor is placed to surround the stator 80. As described above, the rotor is directly connected with the rotational shaft 351. The motor is an outer rotor type motor, and is directly connected with the rotational shaft 351.

The bearing housing 400 is supported from a cabinet base 600 through a suspension unit. The suspension unit can include a plurality of brackets connected with the bearing housing. The plurality of brackets can include radius brackets 430 and 431 extended in a radius direction and shaft brackets 440 and 450 extended in a front and right direction or a rotational direction of the drum.

The suspension unit can include a plurality of suspensions connected with the plurality of brackets.

In this embodiment, the suspensions include three vertical suspensions 500, 510 and 520 and two tilt suspensions 530 and 540 tilted for the front and rear direction. The suspension unit is not fully fixed to the cabinet base 600 but connected with the cabinet base 600 to allow elastic deformation at a certain level, thereby allowing front and rear movement and left and right movement of the drum. In other words, the suspension unit is elastically supported to allow rotation in a front and rear direction and a left and right direction for a point where the suspension unit is connected to the base. The aforementioned suspensions vertically provided for elastic support may be provided in the base 600 using a rubber bushing. The vertical suspensions elastically absorb vibration of the drum while the tilt suspensions attenuate the vibration. In other words, in a vibration system that includes a spring and a damping means, the vertical suspensions serve as the spring while the tilt suspensions serve as the damping means.

The tub is fixed to the cabinet, and vibration of the drum is absorbed by the suspension unit. A front portion and a rear portion of the tub can be fixed to the cabinet. The tub can be mounted on the base of the cabinet and then fixed to the base.

In the laundry machine according to this embodiment, the tub is substantially detached from the support structure of the drum. Also, the laundry machine according to this embodiment has a structure that the tub is not vibrated even though the drum is vibrated. In this case, the vibration amount of the drum, which is transferred to the tub, may be varied depending on the rear gasket.

Also, in the laundry machine according to this embodiment, since vibration of the tub is remarkably small, an interval maintained due to vibration is not required unlike the related art. Accordingly, an outer surface of the tub can be placed near the cabinet to the maximum range. This enables increase of the size of the tub even though the size of the cabinet is not increased, and enables increase of the capacity of the laundry machine in the size of the same appearance.

Substantially, an interval between a cabinet right 630 or a cabinet left 640 and the tub may be 5 mm only. In the laundry machine vibrated with a tub according to the related art, an interval between the tub and a cabinet is 30 mm so that vibration of the tub does not interfere with the cabinet. In this embodiment, a diameter of the tub can be more extended as much as 50 mm than that of the related art. This brings a remarkable difference that can increase the capacity of the laundry machine much more in the size of the same appearance.

Meanwhile, FIG. 2 is a diagram illustrating that a drying duct 40 is provided in the tub 100, 120, and FIG. 3 is a diagram illustrating a section of a top portion at the front of the tub 100, 120 connected with the drying duct 40.

First of all, the tub 100, 120 has a front portion 101 at the front, wherein the front portion 101 is placed prior to a discharge inlet of a drum 300, 320, 340. The front portion 101 is provided with a rim portion 102 projected towards the front, and a front gasket 200 is inserted into the front portion of the rim portion 102. The rim portion 102 is formed in such a manner that its upper portion is more projected towards the front than its lower portion.

A hot air inlet 103 for inflow of the hot air is formed at the upper portion of the rim portion 102. The hot air inlet 103 is upwardly projected from the upper portion of the rim portion 102. A projection angle of the hot air inlet 103 is within the range of 45 degree for a virtual plane where the discharge inlet of the drum 300, 320, 340 is placed. In this embodiment, the projection angle is within 10 degree and is parallel with the discharge inlet.

The drying duct 40 has both ends directly connected with tub 100, 120. The laundry machine of this embodiment does not include a condensing duct unlike the related art. Accordingly, the drying duct 40 is directly connected with the tub 100, 120. In other words, although a circulating passage of the hot air according to the related art is formed in the order of drying duct-tub-drum-tub-condensing duct-drying duct, a circulating passage is formed in the order of drying duct-drum-tub-drying duct in this embodiment. Since the condensing duct exists at the circulating passage of the related art, the hot air flows between the tub 100, 120 and a sidewall of the drum 300, 320, 340, whereby the circulating passage is complicated and long. In more detail, according to the related art, the hot air flows towards the outer surface of the drum between the inner wall of the front portion of the tub and the outer surface of the front portion of the tub. Moreover, since the hot air flows between the sidewall of the tub and the drum, it is not effective in that a part of the hot air does not flow into the drum, stays within the tub, and then is discharged to the condensing duct. Also, if the circulating passage is complicated and long, heat loss may occur, and passage resistance may be increased.

In this embodiment, the drying duct includes a connection duct 40*a* inserted into the hot air inlet 103 and a scroll 40*b* connected with a hot air outlet 121 and provided with a fan 41 therein, wherein the hot air outlet 120 is formed in the tub 100, 120. A heater 44 is provided between the connection duct 30*a* and the scroll 40*b* of the drying duct 40.

The front gasket 200 fixed to the front portion of the rim portion 102 of the tub 100, 120 is provided with a duct connection portion 201 inserted into the hot air inlet 103, and seals the space between the connection duct 40*a* and the hot air inlet 103. The connection duct 40*a* is inserted into the duct connection portion 201 of the front gasket 200. The connection duct 40*a* is upwardly assembled with the drying duct 40 where the heater 44 is provided, and is downwardly assembled with the hot air inlet 103 through snug fit by interposing the duct connection portion 201 of the front gasket 200 therebetween.

As shown in FIG. 3, the hot air inlet 103 is placed at the front of the discharge inlet of the drum 300, 320, 340. A discharge outlet of the connection duct 40*a* inserted into the hot air inlet 103 is also placed at the front of the discharge inlet of the drum 300, 320, 340.

Meanwhile, as shown in FIG. 3, the discharge inlet of the tub 100, 120 is placed at the front of the hot air inlet 103. A door glass 91 of a door 90 that opens and closes the discharge inlet is downwardly tilted towards the drum 300, 320, 340. The door glass 91 is placed below the hot air inlet 103. The hot air discharged from the connection duct 40*a* downwardly strikes the door glass 91 and is switched to the inside of the drum 300, 320, 340. In other words, the upper portion of the door glass 91 assists the hot air discharged from the connection duct 40*a* to flow towards the inside of the drum 300, 320, 340.

In this embodiment, the hot air flows into the drum 300, 320, 340. According to the related art, the hot air flows between the front portion 101 of the tub 100, 120 and the front portion of the drum 300, 320, 340, and the hot air also flows to vertically strike the front portion of the drum 300, 320, 340. Accordingly, according to the related art, only 30% of the hot air flowing from the drying duct 40 flows into the drum 300, 320, 340. The other 70% of the hot air flows between the drum 300, 320, 340 and the tub 100, 120 and then is discharged to the condensing duct. For this reason, it is not efficient in that the hot air cannot be used for drying of laundry placed in the drum 300, 320, 340.

In this embodiment, the tub 100, 120 is tilted in such a manner that its front portion is higher than its rear portion. The front portion 101 of the tub 100, 120 is tilted at the same angle as that of tub based on a vertical line. The drum 300, 320, 340 is also tilted at a similar angle.

However, the discharge inlet of the tub 100, 120 is not tilted but is formed in parallel with the vertical line. This is achieved by more projecting the upper portion of the rim portion 102 of the tub 100, 120 towards the front. In other words, in order to form the discharge inlet parallel with the vertical line from the front portion 101 of the tub 100, 120 tilted at a predetermined angle based on the vertical line, the upper portion of the rim portion 102 is more projected towards the front.

As the tub 100, 120 is tilted as above, a predetermined space is obtained between the upper portion of the front portion 101 of the tub 100, 120 and the inner surface of the front side of the cabinet. The connection duct 40*a* is provided at the obtained space. Of course, unlike the aforementioned embodiment, the tub 100, 120 may not be tilted.

Also, in this embodiment, the tub 100, 120 is fixedly connected with the cabinet. In other words, tub 100, 120 is fixed to the cabinet. In this embodiment, since the tub 100, 120 is little vibrated in comparison with the drum 300, 320, 340, it can stably support the drying duct 40. In more detail, in this embodiment, the front portion 101 of the tub 100, 120 is fastened into a front plate (not shown) of the cabinet and the rear portion of the tub 100, 120 is fastened into a rear plate 620 of the cabinet by a screw or bolt. Also, the tub 100, 120 is provided on a bottom plate 600 of the cabinet in a self-standing type.

Referring to FIG. 2, the drying duct 40 is provided at the center of the upper portion of the tub 100, 120. One end of the drying duct 40 is inserted into the hot air inlet 103 by the connection duct 40*a*, and the other end thereof is laterally bent, so that the other end is connected with the hot air outlet 121 of the tub 100, 120 through the scroll 40*b* where the fan 41 is placed.

A heater 44 for generating the hot air is provided inside the front portion of the drying duct 40, which is placed above the tub 100, 120. The air ventilated by rotation of the fan 41 is heated by the heater 44.

The portion of the drying duct 40 where the heater 44 is placed may be maintained at a high temperature due to heat of the heater 44. Accordingly, an insulating plate 45 is placed between the portion of the heater 44 of the drying duct 40 and the tub 100, 120.

The drying duct 40 is fixedly provided above the tub 100, 120. In this embodiment, the drying duct 40 is fastened to the tub 100, 120 by a screw.

Meanwhile, as shown in FIG. 2, the hot air outlet 121 is formed at a side portion (right side portion in this embodiment) of the upper portion of the circumferential surface of the tub 100, 120. The scroll 40*b* of the drying duct 40 is provided above the hot air outlet 121. The fan 41 placed inside the scroll 40*b* ventilates the hot air into the drying duct 40 by inhaling the hot air from the hot air outlet 121. The fan 41 ventilates the hot air in a radius direction by inhaling the hot air in a rotational direction based on the rotational shaft. Namely, in this embodiment, a centrifugal fan is used.

The direction of the hot air discharged from the hot air outlet 121 is the same as an inhale direction of the hot air inhaled by the fan 41. This structure contributes to more preferable circulation of the hot air. The hot air discharged from the inside of the tub 100, 120 through the hot air outlet 121 flows into the fan 41 in the discharged direction and then is ventilated to the drying duct 40.

The hot air inlet 103 and the hot air outlet 121 are placed above the tub 100, 120. The hot air inlet 103 is placed at the front portion, and the hot air outlet 121 is placed at the rear portion. Also, an angle between flow lines of the hot air of the hot air inlet 103 and the hot air outlet 121 is within 10 degree based on the vertical line. An angle between the flow lines of the hot air inlet 103 and the hot air outlet 121 is within 10 degree. In this embodiment, the flow lines of the hot air of the hot air inlet 103 and the hot air outlet 121 are parallel with each other and their directions are contrary to each other.

The hot air Inlet 103 and the hot air outlet 121 are connected with each other by the drying duct 40 placed above the tub 100, 120. Accordingly, the hot air flows along a simple circulating passage of 'drying duct-tub-drying duct' Since the inside of the tub 100, 120 is relatively wide, passage resistance may be small relatively. In this embodiment, passage resistance may mainly occur in the drying duct 40. In this respect, in the laundry machine according to the related art, in addition to complexity of the passage due to the condensing duct, since the condensing duct is additionally provided, the length of the passage of the duct becomes long, whereby high passage resistance occurs.

Meanwhile, FIG. 4 illustrates the inside of the tub. As shown in FIG. 4, a condensing plate 42 is provided along the inner circumference of the tub 100, 120. In this case, the condensing plate 42 may be formed of a metal material. Although the tub 100, 120 may be formed of a metal material, it can be formed of a plastic material by injection molding. If the tub 100, 120 is made of a plastic material, the condensing plate 42 of a metal material cooler than the plastic material is preferably mounted inside the tub 100, 120 to easily carry out condensing.

For arrangement of the condensing plate 42, three fastening bosses 129*a* and 129*b* are respectively formed at the upper portion and the lower portion of the tub 100, 120 as shown in FIG. 2. The fastening bosses are formed in a way that a screw is fastened inside the tub 100, 120. If the condensing plate 42 placed inside the tub 100, 120 is fixed by tightening a screw outside the tub 100, 120, a fastening hole formed for screw fastening should be sealed. However, if the fastening bosses are formed to fasten the screw inside the tub 100, 120 as described in this embodiment, no sealing is required. In other words, although the fastening bosses 129*a* and 129*b* are formed inside the tub 100, 120 to be projected from the outer circumference of the tub 100, 120, they do not pass through the outer circumference of the tub 100, 120.

The condensing plate 42 is placed at the center of the side portion of the inner circumference of the tub 100, 120. The aforementioned fastening bosses 129*a* and 129*b* are fastened using screws 42*a* and 42*b*. Referring to FIG. 4, the condensing plate 42 is placed at the center of the right inner circumference where the hot air outlet 121 is placed when the inner circumference of the tub 100, 120 is divided into an upper, a lower, a left, and a right portion. In view of the hot air outlet 121, the condensing plate 42 is placed at the Inner circumference below the hot air outlet 121 of the inner circumference of the tub 100, 120. Accordingly, the hot air containing water while passing through the drum 300, 320, 340 is condensed in contact with the condensing plate 42 placed at the inner circumference of the tub 100, 120 before being discharged outside the tub 100, 120 through the hot air outlet 121. In this case, condensing may occur at another inner circumference of the tub 100, 120. Since the condensing plate 42 is made of a metal material, condensing may occur more effectively than the condensing plate 42. The condensing plate 42 may be made of a stainless steel material.

Meanwhile, the hot air passing through wet laundry inside the drum 300, 320, 340 for drying may contain foreign substances such as lint. In order to filter such foreign substances, a filter 52 is placed. The filter 52 will be described in more detail with reference to FIG. 4 to FIG. 10.

The filter 52 is exposed into the tub 100, 120. In particular, the filter 52 is placed on the circumferential surface of the tub 100, 120. The hot air outlet 121 is formed on the circumferential surface of the tub 100, 120, and the filter 52 is placed at the hot air outlet 121.

If the drum 300, 320, 340 is rotated, rotational airflow is formed around the drum 300, 320, 340 by rotation of the drum. The rotational airflow removes foreign substances such as lint stuck on the filter 52 while striking the filter 52. At this time, if there is wet laundry inside the drum 300, 320, 340, water from the laundry can be spread over the inner wall of the tub 100, 120 through the through hole 321 of the drum 300, 320, 340. The spread water can increase the cleaning effect of the filter 52 while striking the filter 52.

Foreign substances such as lint may be fixed to the surface of the filter in a state that they are dried. In this case, if the foreign substances are wetted by water, cleaning can be carried more easily.

The filter 52 is placed inside the hot air outlet 121. If the hot air outlet 121 is projected towards the outside of the tub 100, 120 as shown, the filter 52 may be placed near the inside of the hot air outlet 121, especially near the inner surface of the tub 100, 120. Water (which may be discharged from the laundry depending on RPM of the drum on a laundry course even in case of no dehydrating stroke or cycle, and may be referred to as 'dehydrating water' for convenience's sake) discharged from the laundry or rotational wind by the drum 300, 320, 340 may easily approach to the filter 52. In this embodiment, the hot air outlet 121 is upwardly projected from the upper portion at the rear of the tub 100, 120, and the filter 52 is placed at the lower portion inside the hot air outlet 121.

Unlike this embodiment, the filter 52 may be placed in a way that it is projected towards the inside of the tub 100, 120 from the hot air outlet 121. If there is no interference with the drum 300, 320, 340, the filter 52 may be more projected towards the inside of the tub 100, 120 from the hot air outlet 121.

Meanwhile, the fitter 52 may be formed with a curved surface to obtain a curvature radius equivalent to that of the inside of the tub 100, 120. A difference between the curvature radius inside the tub 100, 120 and the curvature of the filter 52 is within 10% although the difference may be varied depending on where the filter 52 is placed at the hot air outlet 121. Since some of the rotational wind of the drum 300, 320, 340 may approach the filter 52 while flowing along the inner circumference of the tub 100, 120, it is effective for cleaning of the filter that the difference in the curvature radius is not great.

The filter 52 may be placed around the circumferential surface of the drum 300, 320, 340. Although the filter 52 is spaced apart from the drum so as not to interfere with rotation of the drum, the filter 52 may be placed such that more than at least half of the filter 52 is overlapped with the circumferential surface of the drum 300, 320, 340. In other words, when viewed in a radius direction on the circumferential surface of the drum 300, 320, 340, more than half of the viewed portion (see PA of FIG. 10) may be overlapped with the circumferential surface of the drum 300, 320, 340. This is to strike the rotational wind or dehydrating water against the filter 52 relatively strongly by facilitating approach of the rotational wind or dehydrating water of the drum 300, 320, 340 to the filter 52. This embodiment is as shown in FIG. 10.

The filter 52 is provided by a filter assembly 50 in this embodiment. In more detail, the filter assembly 50, as shown in FIG. 6, includes a filter housing 51 on which the filter 52 is mounted. The filter housing 51 is a hollow body and includes an extension portion 51*c* of a predetermined length. The filter 52 is fixed to one end of the filter housing 51. The filter housing 51 may be inserted into the inner surface of the hot air outlet 121 as shown in FIG. 5. The outer surface of the filter housing 51 may be fastened to be fixed to the inner surface of the hot air outlet 121. To this end, in this embodiment, a fastening hole 51*a* is formed in the filter housing 51 such that the outer surface of the filter housing 51 may be fixed to the inner surface of the hot air outlet 121 by screw fastening, as shown in FIG. 6. Alternatively, the outer surface of the filter housing 51 may be fixed to the inner surface of the hot air outlet 121 by snug-fit.

The filter housing 51 may be formed with the same length as that of the extended length of the hot air outlet 121.

Although not shown, a hollow circular shaped filter housing may be formed unlike the aforementioned filter assembly. The filter may be mounted on one side of the circular shaped filter housing. This filter assembly may be fixed to the hot air by hook fastening. Also, this circular shaped filter assembly may be formed in a way that the upwardly extended hollow body except for the lower portion where the filter 52 of the filter housing 51 is mounted in the filter assembly of FIG. 6 is removed.

Meanwhile, in order to more increase the cleaning effect of the filter 52, a filter cleaner may be additionally provided to supply the air or water to the filter 52. If the air is spouted, the filter cleaner may be formed in a way that it spouts the air in an opposite direction of a direction of the hot air passing through the filter 52.

In this embodiment, the filter cleaner supplies cleaning water w. To this end, as shown in FIG. 2, the filter cleaner includes a branch hose 11 branched from a water supply hose 10 for supplying water into the tub 100, 120 and connected with a water supply 121*a* of the hot air outlet 121.

The water supplied from the branch hose 11 is supplied to the outer surface opposite to the inner surface of the filter 52, wherein the inner surface is directed towards the inside of the tub 100, 120. The supplied water flows into the tub 100, 120 while cleaning the filter 52.

The cleaning water w for cleaning the filter 52 can be supplied to the filter 52 when the washing water is supplied to the tub 100, 120. A valve may be placed at a place where the branch hose 11 is branched from the water supply hose 10 or inside the branch hose 10, whereby the time for supplying the cleaning water w to the filter 52 can be controlled. If such a valve is not provided, the cleaning water w will always be supplied to the filter 52 when the washing water is supplied to the tub 100, 120.

As described above, the supplied cleaning water w primarily wets lint stuck on the filter 52 while cleaning the filter 52. In this state, if the drum 300, 320, 340 is rotated, its rotational wind or dehydrating water cleans the filter 52 while striking the filter 52.

Unlike this, the cleaning water w may be supplied in accordance with a predetermined signal. For example, the cleaning water w may be supplied in accordance with a signal of a temperature sensor (not shown) that senses a temperature of the drying duct 40, or may be supplied in accordance with an on/off period of the heater.

If the filter 52 is stopped with lint and the like, the temperature of the drying duct 40 may increase. Accordingly, cleaning timing of the filter 52 can be determined by the signal of the temperature sensor. Also, when a drying stroke that carries out drying while supplying the hot air into the tub 100, 120 is carried out through a drying course, the heater can be on/off controlled repeatedly. If on/off control of the heater is carried out in accordance with the signal of the temperature sensor, the heater can be controlled in a way that it is turned off at a set temperature and again tumed on at the set temperature. At this time, if the filter 52 is stopped, the temperature of the drying duct 40 increases, whereby on-to-off time or off-to-on time of the heater may be varied. As described above, cleaning of the filter can be determined by sensing of the on/off period signal.

Meanwhile, the cleaning water w can uniformly be spread on the outer surface of the filter 52. To this end, as shown in FIG. 9, a spreading nozzle 121*b* such as a shower nozzle may be placed at the water supply of the cleaning water w. In this embodiment, as shown in FIG. 8, a collision surface 51*b* is provided. The cleaning water w strikes the collision surface 51*b* while dropping, and then is spread out over the filter 52.

The collision surface 51*b* may be formed at one end of the filter housing 51 in a single body with the filter housing 51.

Meanwhile, the filter 52 may be a metal filter 52. An example of the metal filter 52 includes a metal wire filter (see upper side of FIG. 7) made of metal wires. Alternatively, the filter 52 may be a mesh filter (see lower side of FIG. 7) made of a plurality of holes on a metal plate. Since the mesh filter can make the surface of the filter 52 smooth, it is advantageous in that lint and the like can easily be removed. Preferably, the metal wire filter has a mesh size less than 30. Since a wire filter having a mesh size more than 30 has too small holes and too many meshes, it may not be preferable to remove lint and the like. In this case, the mesh size is determined by the number of meshes for a vertical length of 1 inch. Namely, mesh of 30 means a mesh size corresponding to 30 meshes for a length of 1 inch.

The type of the filter 52 can be determined considering the cleaning effect of the filter 52 according to RPM of the drum 300, 320, 340. For example, the type of the filter 52 can be determined in a way that the filter 52 is cleaned at 400 rpm or more of the drum 300, 320, 340.

However, if rpm of the drum 300, 320, 340 exceeds 100 rpm in spite of the type of the filter 52, it is noted that the filter 52 is cleaned at a satisfactory level. In particular, in a state that lint and the like are piled up on the filter 52, when dehydrating is carried out at 1000 rpm or more after wet laundry is put in the drum 300, 320, 340, it is noted that the excellent cleaning effect of the filter 52 can be obtained. In this case, the cleaning water w for cleaning the filter 52 is not supplied to the filter 52.

In one embodiment of the laundry machine according to the present invention, the filter 52 is exposed into the tub 100, 120, whereby the filter 52 can be cleaned automatically by the rotational wind or dehydrating water of the drum 300, 320, 340. At this time, the filter may separately be supplied with the cleaning water w through the filter cleaner as described above.

Meanwhile, unlike the aforementioned embodiment, the filter 52 may be placed at a place where it can be cleaned by washing water stored in the tub 100, 120. For example, unlike the aforementioned embodiment, the hot air outlet 121 may be formed below the tub 100, 120 and then the filter 52 may be placed at the hot air outlet 121. In this case, the filter 52 may be cleaned by washing water or rinsing water during a washing stroke or rinsing stroke of the laundry course. As the drum 300, 320, 340 is rotated, the water stored in the tub 100, 120 ascends while forming a water flow, and then approaches the filter 52, whereby cleaning of the filter 52 may be carried out. Alternatively, the filter 52 may be dipped in the water stored in the tub 100, 120 during a washing stroke or rinsing stroke, whereby cleaning of the filter 52 may be carried out.

In the aforementioned embodiments, both washing and drying can be carried out together. Accordingly, the aforementioned water supply hose 10 can be connected to the tub 100, 120 through a detergent box (not shown). Then, the water is supplied into the tub 100, 120 through the water supply hose 10 during washing or rinsing, whereby washing or rinsing can be carried out.

As the case may be, the dehydrating stroke may be carried out after the washing stroke and the rinsing stroke are finished. After the dehydrating stroke is finished, the drying stroke can be carried out. Foreign substances such as lint piled up on the filter 52 during the drying stroke can be cleaned automatically through the washing stroke, the rinsing stroke or the dehydrating stroke.

FIG. 11 is a diagram illustrating a circulating passage of the hot air during drying in the aforementioned laundry machine having a drying function. First of all, the hot air can be generated by the heater 44 inside the drying duct 40 and the fan 41 placed inside the scroll 40*b*. The air ventilated by the fan 41 is heated at a high temperature by the heater 44 and then flows. The hot air flows into the front of the drum 300, 320, 340 through the connection duct 40 inserted into the hot air inlet 103 of the tub front and then flows into the drum through the discharge inlet of the drum.

The hot air flown into the drum 300, 320, 340 is discharged inside the drum 300, 320, 340 through a through hole 321 formed at the sidewall of the drum 300, 320, 340 in a state that it becomes wet in contact with wet laundry. The wet air flown out between the drum 300, 320, 340 and the tub 100, 120 through the through hole 321 is discharged from the tub 100, 120 through the hot air outlet 121 placed at the rear portion of the tub layer 120 while flowing between the tub 100, 120 and the drum 300, 320, 340. In this way, the air discharged through the hot air outlet 121 is circulated in a way that it is inhaled by the fan 41 and again ventilated into the drying duct 40.

In this case, before being discharged through the hot air outlet 121, water contained in the wet air is condensed while the wet air flows between the tub 100, 120 and the drum 300, 320, 340. For useful condensing, heat should be removed from the wet air. The heat is discharged outside the tub 100, 120 by natural convection in contact with the air around the outer surface of the tub 100, 120. In this way, heat is removed from the wet air between the tub 100, 120 and the drum 300, 320, 340 by natural convection through the outer surface of the tub 100, 120, and the water contained in the wet air is condensed.

At this time, water drops will be formed on the surface of the condensing plate 42 and inside the tub 100, 120 due to condensing. The condensing plate 42 may not be required necessarily for natural cooling as above. Although the condensing plate 42 may assist in increasing a condensing rate, the water can be condensed inside the tub 100, 120 and the required condensing rate can be obtained even without the condensing plate 42. A laundry machine having no condensing plate 42 according to another embodiment of the present invention will be described later.

The laundry machine of this embodiment includes a circulating drying system that circulates the hot air. No separate condensing duct is provided, and the space between the drum 300, 320, 340 and the tub 100, 120 serves as a condensing chamber.

The space between the drum 300, 320, 340 and the tub 100, 120 may have a temperature lower than that of the inside of the drum 300, 320, 340. Since the tub 100, 120 is in contact with the outside cold air, condensing may occur at the sidewall of the tub 100, 120 or the condensing plate 42.

FIG. 6 illustrates that the condensing plate 42 is not placed inside the tub 100, 120 as described above. The outer surface of the tub 100, 120 exchanges heat with the outside air through natural convection. The wet air discharged from the drum 300, 320, 340 is in contact with the inner surface of the tub 100, 120, wherein the inner surface has a low temperature. The water contained in the wet air is condensed. The embodiment of FIG. 6 is the same as the aforementioned embodiment except that the condensing plate 42 is not used. Accordingly, additional description will be omitted.

Meanwhile, in the aforementioned embodiments, the space inside the tub is used as the condensing space. Namely, in the aforementioned embodiments, the tub serves as the condensing chamber. However, a separate condensing chamber may be provided. For example, the condensing duct may be used like the related art. In this case, the condensing chamber condenses water of the wet air flowing therein by exchanging heat with the outside air through natural convection. In other words, the condensing chamber may be provided separately from the tub. The condensing chamber may carry out condensing through natural cooling by natural convection.

Also, in the aforementioned embodiments, although condensing is carried out through natural cooling, cooling water or cooling air may be used for forcible cooling. For example, as shown in FIG. 13 and FIG. 14, a cooling water injection portion 122 may be formed at the tub 100, 120 so that cooling water c.w. may be injected into the tub 100, 120. FIG. 13 and FIG. 14 illustrates that the cooling water injection portion 122 is formed at the tub and a passage for flowing cooling water c.w. is formed at the condensing plate 42*a* in the embodiment in which the condensing plate 42 is used.

In this laundry machine, the cooling water injection portion 122 is formed at the tub layer 120. The cooling water injection portion 122 is formed below the hot air outlet.

The cooling water injection portion 122 may have a structure that the cooling water c.w. is injected into the space between the tub and the drum. Alternatively, the cooling water injection portion 122 may have a structure that the cooling water c.w. flows along the inner wall of the tub. In this embodiment, the cooling water c.w. is supplied between the condensing plate 42 and the wall of the tub and then flows along the condensing plate 42. The cooling water c.w. may be discharged to a drainage hole formed below the tub.

A cooling water passage may be formed at the condensing plate 42 so that the cooling water c.w. may flow in a zigzag shape. The cooling water passage is formed by a groove 42*a* formed in the condensing plate.

FIG. 14 illustrates a section of the condensing plate 42 mounted on the inside of the tub. As shown in FIG. 14, the groove 42*a* is formed in the condensing plate 42 towards the wall of the tub to form the cooling water passage. In other words, the groove 42*a* is formed in a way that a surface of the condensing plate 42 facing the wall of the tub is projected towards the inner surface of the tub, whereby the passage is formed between the wall of the tub and the condensing plate 42.

At this time, edges of upper and lower ends of the condensing plate 42 are bent towards the wall of the tub to stop the upper and lower portions of the space where the cooling water c.w. flows. This is to prevent the hot air from flowing into the space where the cooling water c.w. flows if possible. If the cooling water c.w. is exposed to the hot air, particles of the cooling water may flow into the drying duct 40 due to the hot air.

Meanwhile, unlike the embodiment shown in FIG. 13 and FIG. 14, the condensing plate may not be used. In other words, in the embodiment of FIG. 13 and FIG. 14, the cooling water may be injected into the tub through the cooling water injection portion 122. In this case, the cooling water injection portion 122 may be formed so that the cooling water flows along the wall of the tub.

It will be apparent to those skilled in the art that the present invention can be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

INDUSTRIAL APPLICABILITY

The present invention relates to a laundry machine having a drying function for drying an object to be dried, especially clothes. In the laundry machine according to one embodiment of the present invention, lint and the like that may be contained in the hot air are removed by the filter, whereby the lint and the like can be prevented from being piled on the duct. Also, the filter is placed in a way that it is exposed into the tub, whereby the filter can be cleaned automatically while it is being driven.

What is claimed is:

1. A combo washer dryer, comprising:

a tub configured to contain wash water, wherein the tub defines a channel along which hot air supplied from a hot air inlet moves to a hot air outlet and, at the same time, a condensing space in which the hot air is condensed, wherein the hot air outlet is located at a rear of one side of a central axis of the tub, is integrally formed with the tub, and protrudes upward from a rear circumference of the tub, and wherein the hot air inlet is configured to guide the hot air into the rub through a rim formed at a front surface of the tub;

a drum rotatably installed in the tub; and a drying duct coupled to an upper side of the rub, wherein the drying duct connects the hot air outlet and the hot air inlet to form a circulation path for the hot air.

2. The combo washer dryer according to claim 1, further including a filter provided along a flow path of the hot air passing through the hot air outlet to filter lint from the hot air.

3. The combo washer dryer according to claim 2, wherein the filter is installed inside of the hot air outlet.

4. The combo washer dryer according to claim 2, wherein the filter is inserted into and installed in the hot air outlet.

5. The combo washer dryer according to claim 4, wherein the filter is provided at an inner circumference of the tub.

6. The combo washer dryer according to claim 4, wherein the filter is provided at an inner circumference of the tub and protrudes toward the drum.

7. The combo washer dryer according to claim 2, further including a filter housing, in which the filter is mounted, wherein the filter housing is inserted into and installed in the hot air outlet.

8. The combo washer dryer according to claim 7, wherein the filter housing is removably provided at or in the hot air outlet.

9. The combo washer dryer according to claim 2, further including a filter cleaning device to supply cleaning water for filter cleaning to the filter.

10. The combo washer dryer according to claim 9, wherein the filter cleaning device supplies the cleaning water to an outside of the filter.

11. The combo washer dryer according to claim 1, wherein the drum defines a drying space in which drying is carried out using the hot air.

12. The combo washer dryer according to claim 1, further including a fan installed above the hot air outlet to move the hot air.

13. The combo washer dryer according to claim 12, wherein a flow path of the hot air passing through the hot air inlet and the hot air outlet, and a flow path of the hot air moved by the fan extend parallel to each other.

14. The combo washer dryer according to claim 1, further including a front gasket coupled to the rim.

15. The combo washer dryer according to claim 14, wherein the hot air inlet supplies the hot air into the tub through the front gasket.

16. The combo washer dryer according to claim 1, wherein the hot air outlet is located at h one side of the central axis of the tub above a rear circumference of the tub.

17. The combo washer dryer according to claim 1, wherein the hot air inlet, the hot air outlet, and the duct are arranged such that hot air supplied through the hot air inlet is circulated via the drum, the tub, the hot air outlet, and the duct.

18. The combo washer dryer according to claim 1, wherein the hot air outlet is spaced from a perpendicular line passing through the central axis formed in a longitudinal direction of the tub by a predetermined distance.

19. The combo washer dryer according to claim 1, wherein a central longitudinal axis of each of the hot air inlet and the hot air outlet extend at an angle of less than 10 degrees to a vertical line such that hot air advances through the hot air inlet and through the hot air outlet at the angle of less than 10 degrees to the vertical line.

* * * * *